US007525877B2

(12) United States Patent
Harrison, Jr.

(10) Patent No.: US 7,525,877 B2
(45) Date of Patent: Apr. 28, 2009

(54) TIME DISPLAY SYSTEM, METHOD AND DEVICE

(76) Inventor: Shelton E. Harrison, Jr., 6225 Canterbury Dr. #105, Culver City, CA (US) 90230

( * ) Notice: Subject to any disclaimer, the term of this patent is extended or adjusted under 35 U.S.C. 154(b) by 0 days.

(21) Appl. No.: 11/784,303

(22) Filed: Apr. 6, 2007

(65) Prior Publication Data

US 2007/0189123 A1 Aug. 16, 2007

Related U.S. Application Data

(62) Division of application No. 11/438,800, filed on May 23, 2006, now Pat. No. 7,221,624, which is a division of application No. 10/389,050, filed on Mar. 14, 2003, now Pat. No. 7,079,452.

(60) Provisional application No. 60/395,367, filed on Jul. 12, 2002, provisional application No. 60/372,974, filed on Apr. 16, 2002.

(51) Int. Cl.

| | |
|---|---|
| ***G04B 19/00*** | (2006.01) |
| ***G04B 25/00*** | (2006.01) |
| ***G04B 47/06*** | (2006.01) |
| ***G04C 17/00*** | (2006.01) |

(52) U.S. Cl. ..... 368/82; 368/223; 368/239; 368/11

(58) Field of Classification Search ..... 368/62, 368/80, 82–84, 223, 228, 239–240, 10, 11
See application file for complete search history.

(56) References Cited

U.S. PATENT DOCUMENTS 3,616,640 A * 11/1971 Resnicoff ..... 368/227
3,616,643 A * 11/1971 Maue ..... 368/229
3,744,235 A * 7/1973 Kratomi ..... 368/79
3,798,892 A * 3/1974 Lukens ..... 368/77
3,854,279 A * 12/1974 Edmunds ..... 368/82
3,967,389 A * 7/1976 Brooks ..... 434/304
4,006,588 A * 2/1977 McMahon et al. ..... 368/233
4,012,898 A * 3/1977 Yoshizawa ..... 368/78
4,034,554 A * 7/1977 Hadany ..... 368/221
4,044,546 A * 8/1977 Koike ..... 368/70
4,094,464 A * 6/1978 Kawamura et al. ..... 239/17
4,124,945 A * 11/1978 Totten ..... 434/304
4,163,361 A * 8/1979 Mikado ..... 368/107
4,206,592 A * 6/1980 Maue ..... 368/233
4,219,943 A * 9/1980 Grimes ..... 434/304
4,512,667 A * 4/1985 Doulton et al. ..... 368/10
4,647,217 A * 3/1987 Havel ..... 368/10
4,702,615 A * 10/1987 Havel ..... 368/82
4,705,406 A * 11/1987 Havel ..... 368/10
4,707,141 A * 11/1987 Havel ..... 368/11
4,785,432 A * 11/1988 Havel ..... 368/82
4,991,154 A * 2/1991 Perucchi ..... 368/76
5,057,768 A * 10/1991 Havel ..... 324/115
5,422,864 A * 6/1995 Lorello ..... 368/223

* cited by examiner

*Primary Examiner*—Vit W Miska

(57) ABSTRACT

A time display device ("TDD") —equally adaptable to watches, clocks, computers, phones, and vehicles —indicates the current hour of the day by displaying a color that refers an observer to the disclosed color-to-hour matrix, thereby eliminating the traditional hour hand or digit altogether. Alternately adaptable to months, the system may be used with both mechanical and electronic displays. Various disclosed minute indicators provide minute indication by shape, complexity, company logo, air bubbles, or other novel methods. Environmental sensors allow switching between functions. TDD appearance is user-customizable via Internet. Birthstones, gemstones, and precious metals are alternately used as standalone time indicators. Licensing information may be obtained via www.inventerprise.com.

1 Claim, 23 Drawing Sheets

Time depicted (given that digits are gray): 11:17

©2002 S. Harrison

©2002 S. Harrison

FIG. 1F

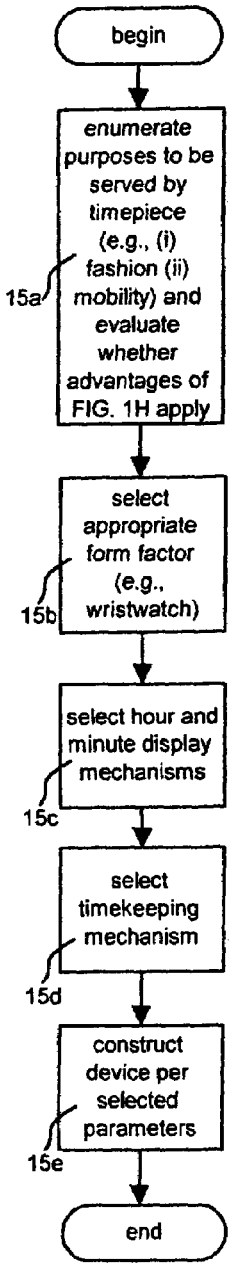

FIG. 1G

EXAMPLE TIMEKEEPING MECH.
quartz
mechanical
atomic clock RF receiver

EXAMPLE HOUR INDICATORS
hour hand
rotating dial
video (e.g., LCD, LED, plasma) display
light projector
leaf indicator EXAMPLE MINUTE INDICATORS
minute hand
hour glass
flat-panel video display
reflective object
leaf indicator

COMPONENT OPTIONS

EXAMPLE HOUSINGS/ FORM FACTORS wristwatch/pocket watch
desk clock/alarm clock
wall clock
standing clock (e.g., grandfather)
automobile dashboard
television
VCR/DVD player
cable set-top box
microwave oven/other appliance
mobile telephone/pager
radio/stereo
office building
computer/handheld PC (PDA)
aquarium/other container

FIG. 1H

EXAMPLE ADVANTAGES OF COLOR-TO-HOUR ENABLED APPROACH

Less obtrusive and repetitive than digits or hands

More flexible and scaleable for fashion and industrial design, works with virtually any minute indicator More attractive, intuitive, subtle, artful Colors can be read by anyone in the world, i.e., universal language Colors can be read in "one glance" and from greater distances than digits Allows the use of precious metals and gemstones as functional information indicators rather than strictly as ornaments Allows almost infinite user configurability, customization Provides the same precision as digits or hands and is easy to learn Time depicted (given brown being displayed by flat-panel): 9:15

©2002 S. Harrison

Time depicted (given brown being displayed by flat-panel): 9:20

Time depicted (given that digits are gray): 11:17

©2002 S. Harrison

FIG. 5B
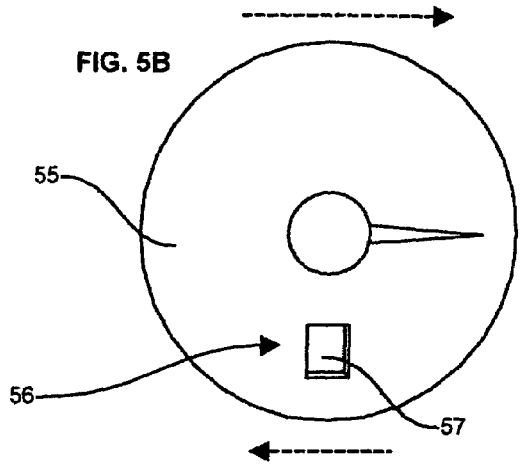
Time depicted (assuming the color green visible through aperture): 6:15
FIG. 5C
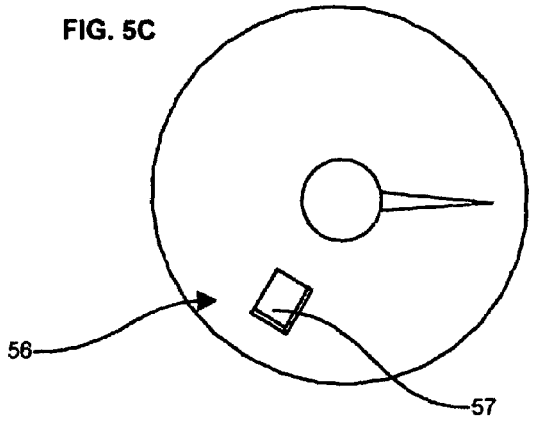
Time depicted (blue visible through aperture): 7:15
FIG. 5D
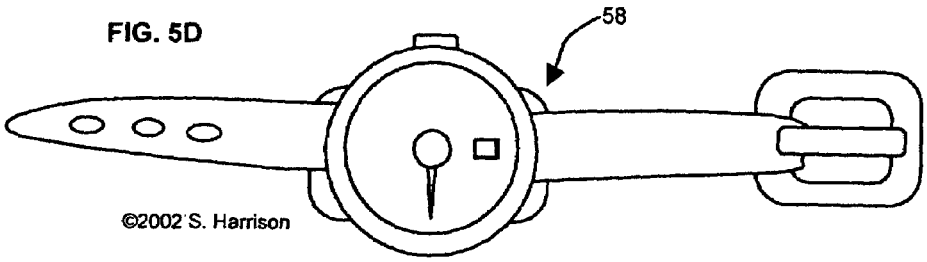
FIG. 5E
| HYBRID TDD OPTIONS | |
|---|---|
| Hour/Color Display | Minute Display |
| Elec. display → | Minute hand |
| Elec. display → | Digit |
| Reflective dial → | Minute hand |
FIG. 5F
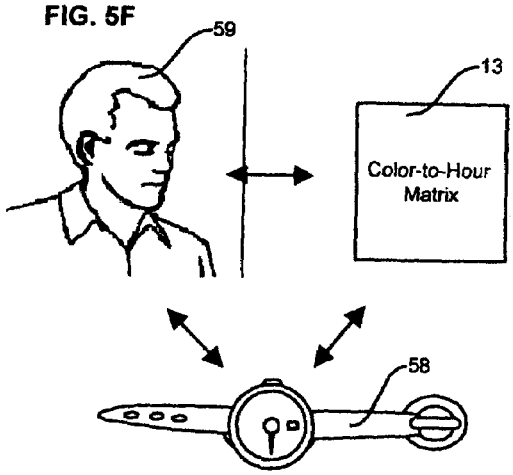

©2002 S. Harrison

©2002 S. Harrison

©2002 S. Harrison

©2002 S. Harrison

©2002 S. Harrison

©2002 S. Harrison

©2002 S. Harrison

©2002 S. Harrison

©2002 S. Harrison

©2002 S. Harrison

FIG. 23A configuration profile modification page

Your current display settings are:
22 red 45 green 37 blue 50 contrast 50 brightness
Input new number to adjust your settings
__ red __ green __ blue __ contrast __ brightness

Please select the display mode you wish to use:

- ○ five circles per hour
- ○ container fills with water
- ◉ standard single bar image
- ○ single bar image + last and next hour
- ○ single bar image + all 11 hours Please select a background image

- ○ blue swirl
- ○ grey clouds
- ○ red bricks
- ○ brown leather
- ◉ use the following image (insert URL of image to be used below)

HTTP://www.ePoet.com/images/example.JPEG browse submit

FIG. 23B additional selections page

You have chosen: STANDARD SINGLE BAR IMAGE

Please indicate additional selections for this display mode:

- ◉ display a ruler line?
- ◉ outline hour images in white?
- ○ active hour image ends in an arrow?
- ○ use color differentiation aids?
- ◉ active hour image pulses?

submit choose a different display mode

FIG. 23C synchronize information page

You have successfully updated your configuration settings!

If you have already installed the necessary synchronization software on your computer, and your time display device is connected to your computer properly, you can click on the synchronize button below to have your new configuration settings downloaded directly into your time display device for immediate use.

If you need to install sync software, click here to select and download the appropriate software.

synchronize

FIG. 24A

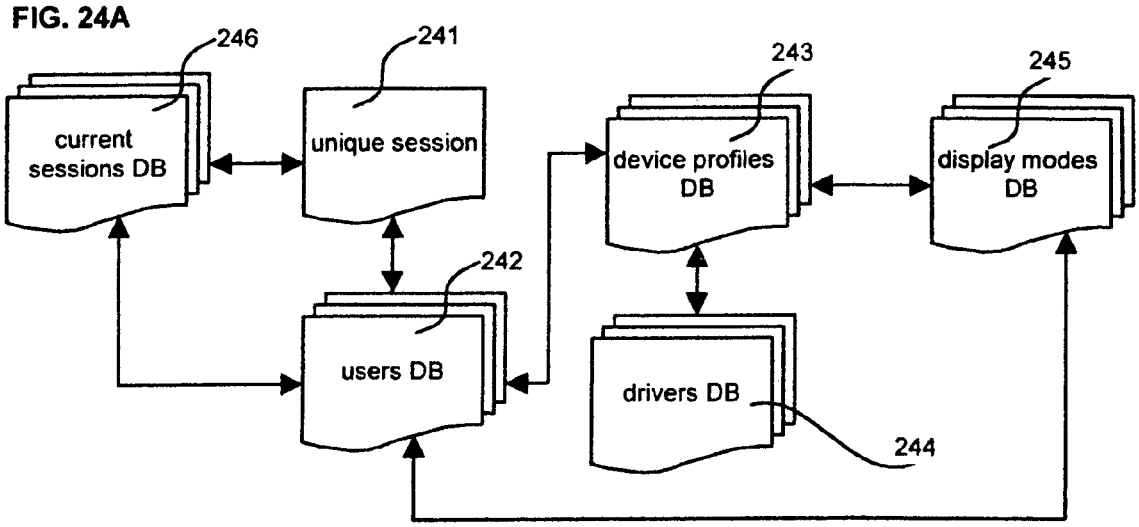

FIG. 24B

EXAMPLE DISPLAY MODE OPTIONS

HOUR BY:
Numerical digit (e.g., FIG. 3B)
Active hour image (e.g., FIGS. 10A-19C)

MINUTE BY:
Numerical digit (e.g., FIG. 3A))
Feature sequence, such as:
- Image size (e.g., FIG. 10A)
- Image shape (e.g., FIG. 11A)
- Image number (e.g., FIG. 12A
- Image amplitude (e.g., FIG. 13A)
- Image complexity (e.g., FIG. 14B)
- Image position (e.g., FIG. 15)
- Image speed (e.g., FIGS. 17A-17B)

FIG. 28
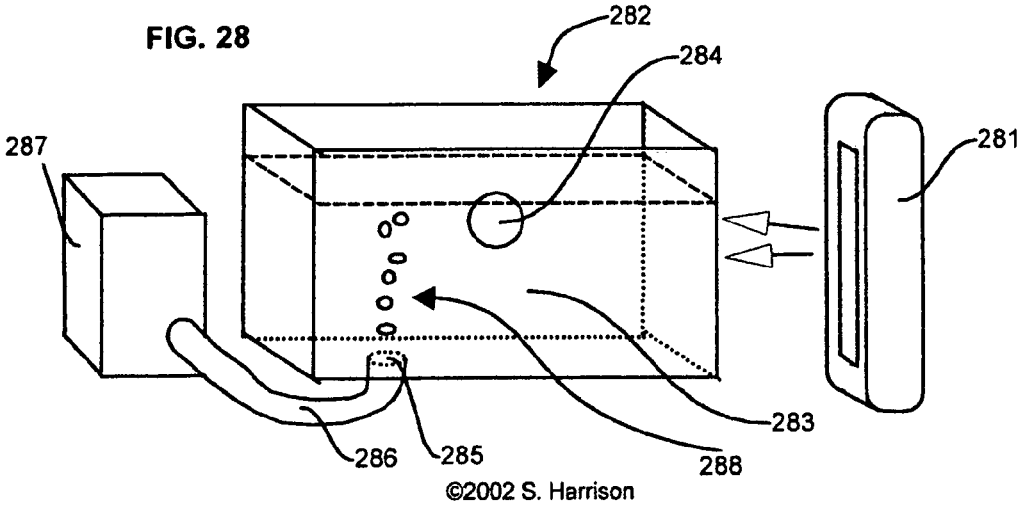
©2002 S. Harrison
FIG. 29
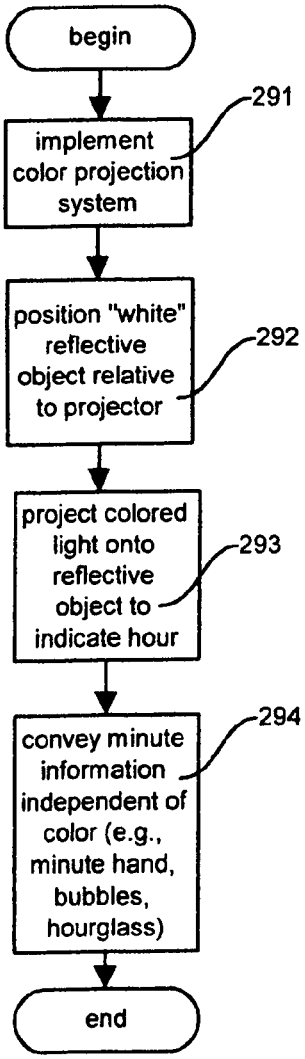
FIG. 30
PROJECTOR-FRIENDLY COLOR-TO-HOUR MATRIX
301
| COLOR | HOUR |
|---|---|
| [blink] | 12:00 |
| white | 1:00 |
| violet | 2:00 |
| red | 3:00 |
| orange | 4:00 |
| yellow | 5:00 |
| green | 6:00 |
| blue | 7:00 |
| purple | 8:00 |
| brown | 9:00 |
| peach | 10:00 |
| aqua | 11:00 |
©2002 S. Harrison

311

FIG. 31A

EXAMPLE COLOR POOL FOR PRECIOUS MATERIALS

| | |
|---|---|
| onyx | silver |
| pearl | gold |
| opal | platinum |
| ruby | diamond |
| topaz | jade |
| amber | garnet |
| emerald | carenelian |
| sapphire | jacinth |
| amethyst | beryl |
| turquoise | cat's eye |
| chalcedony | chrysoprase |
| agate | ivory |
| bloodstone | coral |
| moonstone | malachite |
| sard | peridot |
| lapis lazuli | ebony |

312

FIG. 31B

EXAMPLE COLOR-TO-HOUR MATRIX FOR PRECIOUS MATERIALS

| COLOR | HOUR |
|---|---|
| onyx | 12:00 |
| pearl | 1:00 |
| tourmaline | 2:00 |
| ruby | 3:00 |
| topaz | 4:00 |
| amber | 5:00 |
| emerald | 6:00 |
| sapphire | 7:00 |
| amethyst | 8:00 |
| turquoise | 9:00 |
| silver | 10:00 |
| gold | 11:00 |

©2002 S. Harrison

FIG. 32

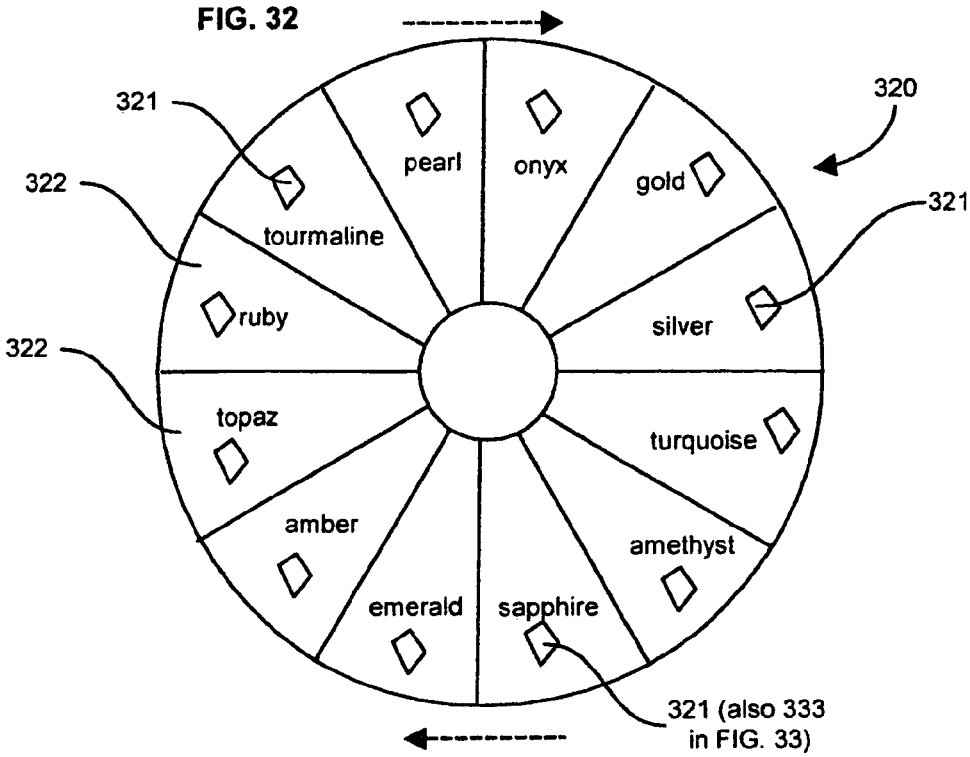

©2002 S. Harrison

FIG. 33
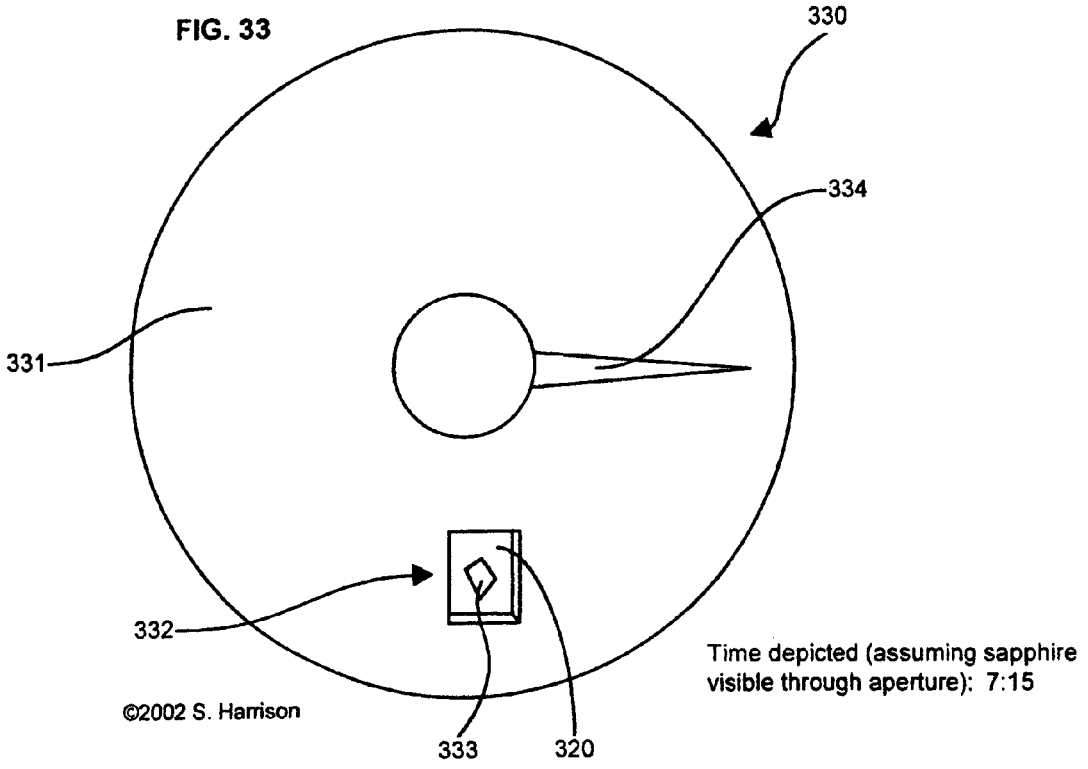
FIG. 34
COLOR
TO MONTH MATRIX FOR
BIRTHSTONES
340
| MONTH | STONE |
|---|---|
| January | Garnet |
| February | Amethyst |
| March | Aquamarine |
| April | Diamond |
| May | Emerald |
| June | Pearl |
| July | Ruby |
| August | Peridot |
| September | Sapphire |
| October | Opal |
| November | Topaz |
| December | Turquoise |
FIG. 35
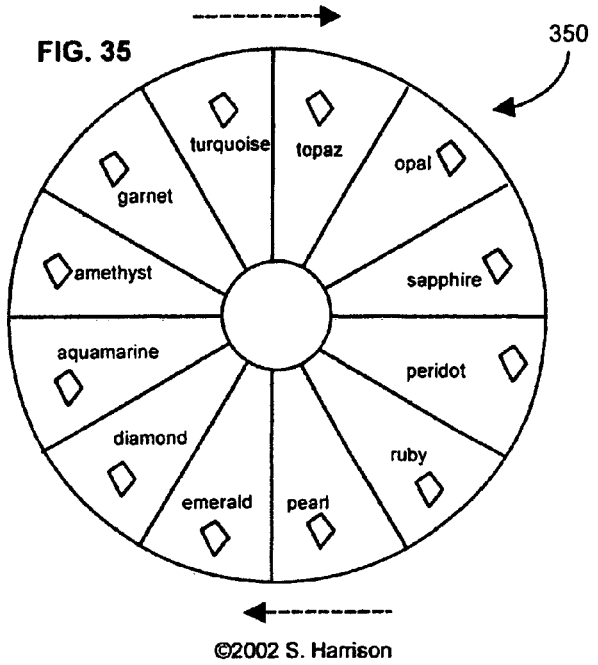

FIG. 36

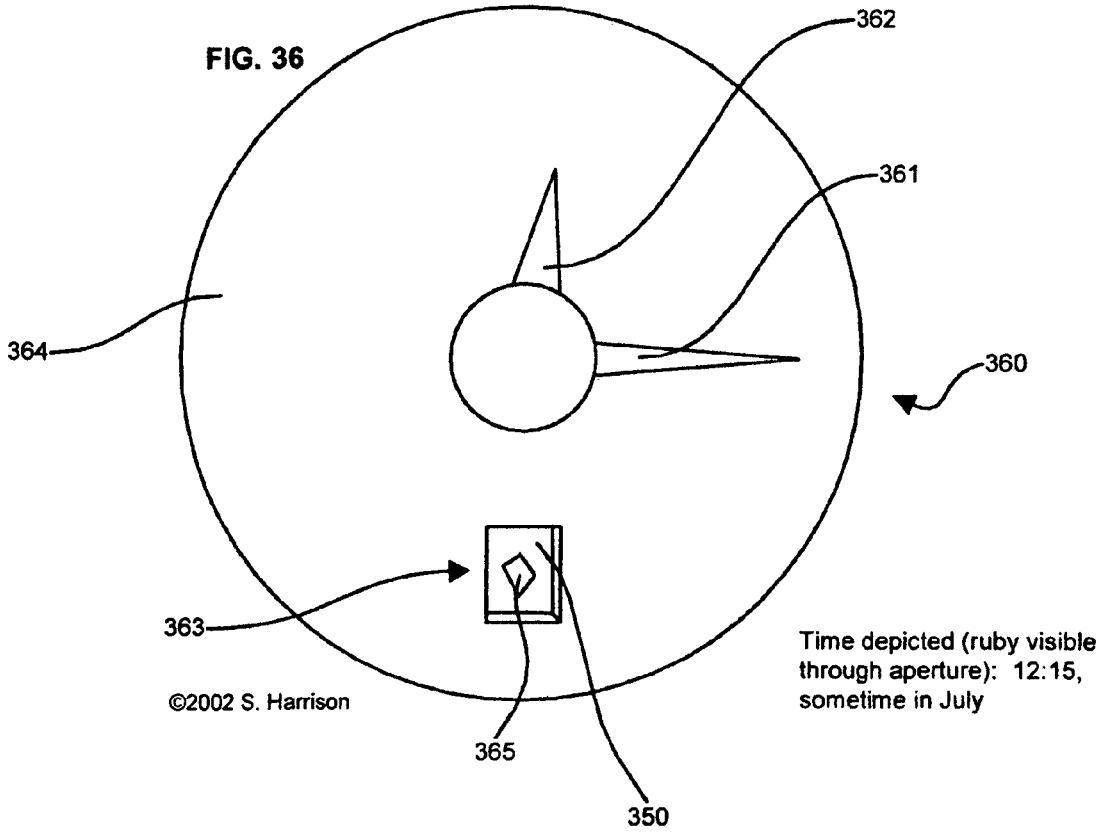

FIG. 37

EXAMPLE COLOR-TO-MONTH MATRIX
USING FOR ZODIAC CALENDAR

| COLOR | ZODIAC SIGN |
|---|---|
| black → | Aries (March 21 - April 19) |
| white → | Taurus (April 20 - May 20) |
| pink → | Gemini (May 21 - June 20) |
| red → | Cancer (June 21 - July 22) |
| orange → | Leo (July 23 - August 22) |
| yellow → | Virgo (August 23 - September 22) |
| green → | Libra (September 23 - October 23) |
| blue → | Scorpio (October 23 - November 21) |
| purple → | Sagittarius (November 22 - December 21) |
| brown → | Capricorn (December 22 - January 20) |
| tan → | Aquarius (January 21 - February 19) |
| gray → | Pisces (February 20 - March 20) |

370

©2002 S. Harrison

FIG. 40A

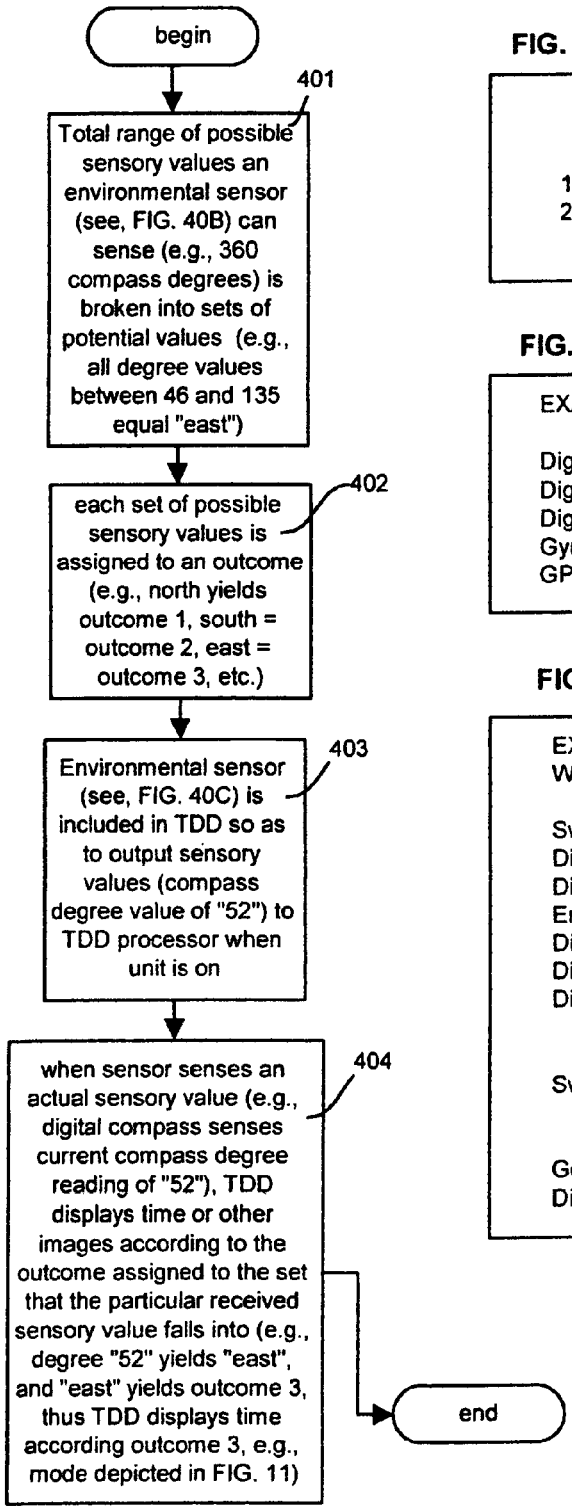

FIG. 40B

| Values | Sets | Outcomes |
|---|---|---|
| 46-135 | East | Outcome 3 |
| 136-225 | South | Outcome 2 |
| 226-315 | West | Outcome 4 |
| 316-45 | North | Outcome 1 |

FIG. 40C

EXAMPLE ENVIRONMENTAL SENSOR OPTIONS

Digital compass
Digital light meter
Digital level
Gyroscope-based sensor
GPS receiver

FIG. 40D

EXAMPLE FUNCTIONS ASSOCIATED WITH OUTCOMES

Switch to time display mode of FIG. 3A
Display time in mode of FIG. 10A
Display time in mode of FIG. 11A
Enter sleep mode
Display background image only
Display time in randomly selected mode
Display phone numbers or other contact info stored in memory (for PDA or mobile phone embodiments)
Switch to other personal information management programs (e.g., date book, spreadsheet software, etc.)
Go to next record (in database)
Display nothing ©2002 S. Harrison ©2002 S. Harrison Time depicted (assuming "7" is yellow): approximately 7:24

©2002 S. Harrison

Time depicted (assuming "8" is blue):
8:00 or shortly thereafter

TIME DISPLAY SYSTEM, METHOD AND DEVICE

CROSS-REFERENCE TO RELATED APPLICATIONS

This application is a divisional application of U.S. patent application Ser. No. 11/438,800, filed May 23, 2006 now U.S. Pat. No. 7,221,624, which is in turn a divisional application of U.S. patent application Ser. No. 10/389,050, now U.S. Pat. No. 7,079,452, filed Mar. 14, 2003, which application claimed priority filing of U.S. provisional patent application 60/395,367, filed Jul. 12, 2002, and U.S. provisional patent application 60/372,974, filed Apr. 16, 2002.

STATEMENT REGARDING FEDERALLY SPONSORED RESEARCH AND DEVELOPMENT

None.

REFERENCE TO SEQUENCE LISTING, A TABLE, OR A COMPUTER PROGRAM LISTING APPENDIX

None.

BACKGROUND OF THE INVENTION

A portion of the disclosure of this patent document contains material which is subject to copyright protection. The copyright owner has no objection to the facsimile reproduction by anyone of the patent documents or patent disclosure, as it appears in the Patent and Trademark Office patent file or records, but otherwise reserves all rights whatsoever.

1. Field of the Invention

The present invention relates to clocks, watches, and electronic displays.

2. Description of Related Art a. The Need for an Alternative Time Display Method Clocks and watches serve (i) a time-keeping function, (ii) a time display function, and (iii) an ornamental/fashion function. Although a number of time display methods have been created over the centuries, only two time display methods are commonly used in modern clocks and watches, namely: (i) the traditional analog clock approach, which provides a minute hand and an hour hand set against a clock face, and (ii) the numerical digit display approach, which provides one or two digits representing the hour to the left of a colon, and two digits to the right of the colon representing the minute, as in the case of "3:52".

While both of these time display methods can accurately and precisely convey time of day information to an observer, they are both limiting from a design perspective. Numerical digits, no matter how they are dressed up, are ultimately still just numerical digits. Incorporated into calculator watches, VCRs, mobile phones, and many other devices, numerical digit displays are highly functional but almost as highly repetitive and unattractive.

Meanwhile, the analog clock display is a little more aesthetically pleasing but no less repetitive. Whether six millimeters long or six feet long, a minute hand is still a minute hand, and it functions just like every other minute hand in the world, from the minute hand on a luxury watch to the minute hand built into a giant clock tower. Every analog clock design, therefore, must be built to accommodate the same basic features, namely, rotating clock hands.

As a result of these limitations, the time display function served by modern clocks and watches often clashes with the fashion and ornamental function. This tension can be most easily observed in the field of luxury watches, where designers, struggling to make the same old time display method look new, produce gold and diamond watches that are beautiful —but impossible to read.

What is needed, therefore, is a new time display method that conveys time of day information as accurately and precisely as the two major conventional time display methods yet suffers from fewer limitations from a fashion design or industrial design perspective.

b. Prior Offerings of Alternative Time Display Methods

Recognizing the limitations of the two major time display methods, modern inventors have sought to offer alternatives. Each of these offerings also suffers from its own inherent limitations. The limitations typically fall into one of the following categories: (i) time is displayed accurately and precisely, but reading or learning to read the display is prohibitively difficult; (ii) time is displayed accurately, but unacceptably imprecisely; (iii) time is displayed in the traditional analog or digital method, but "a twist" is added that makes for a difference without any apparent advantage.

Time display methods and devices in the first category include the following:

Bik, U.S. Pat. No. 5,228,013 to Bik, provides a colorful "clock-painting" device and method which conveys time information by electronic pulses, wherein the number of pulses indicates time quadrants and other variables which, taken together, can be deciphered to reveal the time of day. However, as the inventor admits in the disclosure itself, the time display method disclosed therein requires a "time-consuming data extraction process." The same criticism can be leveled at other alternative methods in this category, such as Cordova, U.S. Pat. No. 5,526,327 (providing a time display method and device in which container-like areas fill over time to indicate the passing of hours, minutes and seconds) and Lyon, U.S. Pat. No. 5,896,348 (providing a method and device whereby time information is conveyed through groups of binary indicators).

These offerings have also tended to lack "backward compatibility," meaning, they provide no mechanism through which users can leverage their existing time-telling skills.

What is needed, therefore, is an alternative time display method and device that is easier to learn and to use than prior alternative offerings.

In the second category are offerings such as:

A web designer named or working for "Ralf Einhorn" has created a computer-animated image that changes color continually, moving gradually in time through the color spectrum. This designer has published a single web page that displays said image as a "clock." Though this publication appeared after the filing dates of the above provisional patent applications, this image merits discussion, since it serves to highlight the effectiveness of the color-to-hour invention. As the Einhorn web page and image show, such gradual color change may be an interesting aesthetic idea, but it is severely deficient as a time indicator: the image, black at midnight, turns red by about 3:00 a.m. and remains such til about 7:00 a.m. Thereafter, the image gradually turns to orange, then to yellow to green to blue by about 5:00 p.m., as per the color spectrum, and then turns to black again by midnight. Thus, under Einhorn, even a keen observer would be unable to tell current time with any more precision than about a four-hour window. Meanwhile, Einhorn provides no mechanism for the indication of minutes whatsoever.

To summarize, the color spectrum (discussed below) does not offer enough discretely recognizable intervals to indicate the 1440 minutes in a day or to enable the present invention. Moreover, as Einhorn demonstrates, imperceptibly small changes of degree along a continuum do not serve as precise time of day indicators. Hours of the day change by clearly differentiated steps occurring at precise intervals, not by indefinite motion along a continuum.

What is needed, therefore, is an exact, stepwise indicator of hours combined with a precise indicator of minutes, not a vague approximation of the time of day that provides no distinction between hours and minutes.

In the third category are offerings such as:

Graves, U.S. Pat. No. 6,198,698, provides a device in which time information is conveyed by way of a pie chart-like pattern that corresponds to the motion of a minute hand and illumination of a digit representing the hour of day. Clearly mimicking the function of a traditional analog clock, the Graves device provides a difference without an apparent advantage.

What is needed, therefore, if an alternative time display method is to be employed at all, is identifiable advantages over the conventional digital or analog methods.

c. Other Prior Art in which Color is Used

The present invention offers a time display system which meets the above requirements through an innovation called a "color-to-hour matrix", through which color serves as an absolute, stand-alone, step-wise hour indicator.

By contrast, color is irrelevant in the conventional time display methods: a black minute hand conveys the same information as a gold one. Color usage in clocks therefore typically falls into the following categories: (i) strictly ornamental usage, by far the largest category; (ii) teaching aids for children; and (iii) indication of supplementary information, such as time zone, elapsed time (as opposed to time of day), etc.

Ornamental, decorative usage of color in clocks includes:

Thousands of "novelty" clocks, too numerous to mention here, which are in the shape of animals, people, sports equipment, etc., but display the time using a conventional method. Also in this category are some patented offerings, such as, Vole, U.S. Pat. No. 4,845,689 (clock made to look like a traffic light with red, amber, and green lenses); Hadany, U.S. Pat. No. 4,034,554 (rotating color cylinders change orientation causing continuous change in color of display).

Devices using color to convey supplementary information include:

U.S. Pat. No. 4,006,588 to McMahon et al. (time dial divided into colored areas ranging in length from one to three hours, each area representing a portion of a child's day, e.g., lunchtime); U.S. Pat. No. 4,028,876 to Delatorre (two compounds react to change color to indicate elapsed time over the course of one to 30 days); U.S. Pat. No. 4,702,615 to Havel (variable colors used to indicate relationship of current time to certain time limits); and the U.S. Pat. No. 5,638,341 to Amano (colors used to represent periods of the day related to traditional Indian medicine).

Teaching aids for teaching children how to tell time include:

Brooks, U.S. Pat. No. 3,967,389 employs color to help children understand a minute and hour hand; see also, Grimes, U.S. Pat. No. 4,219,943; Bradt, U.S. Pat. No. 6,354,841; Massaro, U.S. Pat. No. 4,885,731; Totten, U.S. Pat. No. 4,124,945.

The Totten device is the most relevant of the teaching aids because it provides a circular clock face divided into twelve different-colored segments. However, this multicolored clock face serves only as a backdrop for standard analog hands. As such, neither this clockface itself nor the colors on it do or can serve to indicate the time of day.

In contrast, the color dials in the present invention do serve as time indicators. This function is only made possible by the intermittent, relative motion of the color dial combined with the hiding of eleven of the twelve color segments, which novel mechanics are neither taught by nor possible under Totten.

Meanwhile, colors are used to convey information in devices unrelated to time display. For instance, colors are used instead of words in traffic lights, where the red means "stop," and green means "go." Ambient Devices, a company, makes objects that change color gradually according to the performance of the stock market or other variables.

Note that the stepwise color change of a stop light —providing three distinct colors that mean three distinct things —has proven very effective in society at large. One can imagine, however, that if this indicator were gradual, i.e., a stoplight gradually changed from green to red, the resulting confusion would be quite dangerous, since no one would know exactly when to stop and when to go. Similarly, as the failure of the Einhorn approach demonstrates, the precision of the present color-to-hour system would be impossible using gradual color changes rather than the disclosed stepwise color changes.

d. Overcoming the Shortcomings in Prior Art

When white light is passed through a prism, it separates into the basic "rainbow colors": red, orange, yellow, green, blue, indigo, and violet. These seven colors are not enough discreetly recognizable colors to enable a one-to-one color-to-hour matrix such as that disclosed herein. But by adding other light phenomena which humans perceive as distinctly recognizable colors but which do not appear in the pure color spectrum, such as brown, black, gray and so on, a group of twelve identifiable colors that can be distinguished from each other by most human beings is produced, thereby enabling the disclosed color-to-hour matrix.

Once a particular sequence of color-to-hour assignments has been established for this color-to-hour matrix, this information makes possible an entirely novel time display method that eliminates the traditional hour hand altogether in favor of displaying a color that in and of itself is sufficient to indicate the exact current hour of the day.

This new method is combined with traditional, color-independent methods of conveying minute information so that no more learning is necessary for the new display method to be effectively used. Such combining of a stand-alone, exact indicator of hours solely by color with a color-independent indicator of minutes is itself also an entirely novel time display method.

Alternately, the new method of conveying hour information is combined with new methods of conveying minute information, thereby allowing greater latitude in terms of fashion and industrial design than prior methods allow.

Thus, an alternative time display method is achieved to meet the requirements stated above. Myriad devices illustrating the flexibility of this approach are disclosed.

e. The Trend Toward User Configurability

Information technology users have grown to expect more and more ability to customize the tools with which they work. Desktop, laptop, Internet and handheld computer environments all offer a number of user preferences that can be immediately changed by a user at will.

Meanwhile, typical clocks and watches are designed to have a single, fixed appearance. For instance, if a user purchases a gold watch with two black hands, she cannot easily change the look of her watch, e.g., exchange the black hands for gold hands, unless she happens to be a jeweler. Ideally, however, a user would be able to change the way her clock or watch looks quickly and conveniently at will, e.g., to change her watch to match her daily clothing selection.

At least one prior attempt to make a user-configurable clock appears in Bodet, U.S. Pat. No. 3,972,179. What is needed therefore is a way of allowing users to change the appearance —colors, textures, shapes, etc. —of the displays of their watches and clocks easily.

f. Other Prior Art Incorporated into or Related to the Present Invention

Other prior art used by or related to the present invention includes "anadigi" clocks, in which both the digital and the analog methods of time display are included in the same device (e.g., Besson, U.S. Pat. No. 4,413,915; Burdet, U.S. Pat. No. 4,320,484); timekeeping mechanisms, such as quartz and mechanical movements; "atomic watches", which receive radio transmissions from the U.S. national atomic clock in Fort Collins, Colo., so that they remain in almost perfect synchronization with official United States time, such as the digital "Atomic Watch" from LaCrosse Technology; "jump hour" watches (e.g., Vuille, U.S. Pat. No. 4,259,735), some of which eliminate the hour hand altogether in favor of a rotating dial inside the watch which turns intermittently at the top of each hour and displays the current hour through a window in the watch face; watches that include a date function, wherein a rotating dial indicates date and month information (e.g., Watanabe, U.S. Pat. No. 4,228,644); means of transferring, exchanging uploading, downloading, and synchronizing information between a portable device and a local or remote computer via the Internet by establishing a data transfer link (infrared, USB cable, docking station, etc.), as in the case of synchronizing a Palm PDA and a Yahoo! online address book, via IntelliSync software (see, e.g., U.S. Pat. No. 6,304,881 to Halim); liquid crystal displays, light-emitting displays, touch-sensitive displays, and other flat-panel displays, both color and black and white; software and systems which allow a user to customize the way information is displayed, such as the case of a user setting a color scheme for her My Yahoo! account (see, e.g., http://my.yahoo.com); software that enables a graphical image to be displayed by an electronic flat-panel display, and which allows such images to change in size, shape and other characteristics, such as Macromedia Flash animations; devices which trigger electronic or mechanical events to occur at a particular time of day, such as a clock alarm or an in-home safety device that turns lights on and off at particular times of day; air and water compressors and pumps; aquariums, hourglasses, and other containers; odometers and the gear mechanisms used therein to cause intermittent motion of a dial or drum; light projectors and colored gels for use therewith, as in the case of theatrical spotlights (e.g., Leon, U.S. Pat. No. 4,232,359); digital compasses, which can be carried or worn by a user, and which output digital directional information in degrees ranging from 0 through 359; other environmental sensors, which output digital information pertaining to latitude, longitude, tilt, pitch, yaw, motion, and light intensity (see e.g., SDL30 digital level from Instrument Sales; DLM2 digital light meter from Sherman Instruments; PDC803 digital compass from Smart Home; Bosch DLE30 Plus digital distance meter; gyroscopic sensors for use with data processing systems, such as the GyroMouse from Gyration, Inc.); GPS receivers, including those which plug-in to PDAs or are included in other portable devices (e.g., GeoDiscovery's Geode GPS); operating systems, which allow a user to switch from one software program to another; clocks which display zodiac calendar information (Frank, U.S. Pat. No. 4,435,795; Strader, U.S. Pat. No. 5,197,043); timekeeping devices that include a compass or other environmental sensor in communication with a microprocessor for performing certain calculations automatically (Doulton, U.S. Pat. No. 4,512,667); database management software, such as that produced by Oracle or FileMaker; HTML forms processors, Web browsers, Web servers, client/server systems; power supplies, including portable batteries, wall outlets, and automatic or self-winding watches; and perpetual calendar timepieces and gears (e.g., Groothuis, U.S. Pat. No. 4,427,300).

BRIEF SUMMARY OF THE INVENTION

Display of hour information. The present invention provides a system for displaying time of day information wherein color serves as a stand-alone, self-sufficient indicator of the current hour of the day, thereby altogether eliminating the need for an hour hand or hour digit. A different color is uniquely assigned to each of the twelve hours typically displayed by a traditional analog clock so as to establish a color-to-hour matrix wherein there is a one-to-one correspondence between a given hour of the day and the color assigned to it. This color-to-hour matrix is then referenced by a device that displays one of the colors in the color-to-hour matrix, thereby indicating that the current hour of the day is the hour that the displayed color uniquely represents.

Display of minute information: hybrid embodiments. So as to minimize the burden upon users to relearn how to tell time, the present invention provides a hybrid system for displaying time of day information in which minute information is displayed by a standard minute hand or by numerical digits while hour information is conveyed according to the color-to-hour matrix reference system summarized above; this hybrid approach represents a "bridge" technology that facilitates consumer acceptance of a new time display method.

Display of minute information: nonhybrid embodiments. Alternatively, the present invention also provides time display methods, called "feature sequences" in which minute information is conveyed by way of size, shape, orientation, complexity, texture or other variable features of the appearance of an electronically generated image.

User configuration and data exchange. The present invention also provides a system for user configuration of the appearance of a time display device and user selection of different time display modes. Appearance information can be modified by direct manual interface with the time display device or data exchange between the time display device and a computer under the control of the user, which computer may in turn exchange data with one or more other computers by way of the Internet. Alternative embodiments provide mechanisms by which environmental sensors can be used to switch automatically between display modes.

Hardware devices. The present invention also provides numerous alternative embodiments of hardware devices which use the above time display, user configuration and/or data exchange systems. These devices can include mechanical gears which control moving clock hands and multicolored dials, electronic displays which display virtual images, or color projectors which project a color onto a reflective surface. These devices may also include precious metals or gemstones —serving a functional rather than just an ornamental role —and may be incorporated into any number of form factors, including wristwatches, wall clocks, consumer electronics devices and more.

Display of month information. The hardware devices disclosed herein for use with the color-to-hour matrix system are also used to provide a new method of indicating the current month of the year by displaying a color or a precious stone or metal.

BRIEF DESCRIPTION OF THE DRAWINGS

FIG. 1F depicts a flowchart illustrating the process by which a device that executes the two-step process in FIG. 1E is designed and constructed.

FIG. 1G depicts a group of timekeeping mechanisms, hour display mechanisms, minute display mechanisms, and housings or form factors which may be used for the components of physical devices embodying the present invention.

FIG. 1H depicts a group of advantages made possible by a device that conveys time information by reference to the color-to-hour matrix.

FIGS. 5B and 5C depict an anterior view of a time display device whereof the clock face turns so as to reveal a portion of a multicolored dial, thereby indicating the active hour.

FIG. 5D depicts an anterior view of a wristwatch that includes the time display device depicted in FIG. 5B.

FIG. 5E presents a chart summarizing the different combinations of minute and hour indicators which may be used in creating a hybrid time display device.

FIG. 5F depicts a schematic overview summarizing the systemic relationship between the time display device, the color-to-hour matrix, and the observer to whom time information is being communicated.

FIG. 23A depicts a portion of a web page with a submission form displayed by web browser software through which a user submits configuration information to a remote computer.

FIG. 23B depicts a portion of another web form through which a user submits additional configuration information to a remote computer via the Internet.

FIG. 23C depicts a portion of another web page which allows a user to activate synchronization software.

FIG. 24A depicts a schematic overview of additional databases stored in the memory of a remote server computer for management of the process by which users can configure time display devices via the Internet.

FIG. 24B depicts a chart of display modes that may be included as separate records in a display modes database.

FIG. 28 depicts a perspective view of a time display device for use in a time display system in which a light projector projects light into a container containing a reflective object wherein minute information is conveyed by bubbles.

FIG. 29 depicts a flowchart illustrating the process by which a system in which hour information is indicated by projecting colored light upon a reflective surface is implemented.

FIG. 30 depicts a color-to-hour matrix suitable for use with a light-projecting device.

FIG. 31A depicts an alternative color pool wherein all the colors are colors of precious materials, e.g., precious and semiprecious stones and precious metals. FIG. 31B depicts a color-to-hour matrix using a subset of colors drawn from the color pool depicted in FIG. 31A.

FIG. 32 depicts an alternative color dial inlaid with precious materials.

FIG. 33 depicts an anterior view of the essential components of a time display device for use in a system in which hour information is indicated by the display of a precious material and minute information is indicated by a minute hand.

FIG. 34 depicts a matrix in which gemstones are uniquely assigned to calendar months.

FIG. 35 depicts an anterior view of an alternative color dial in which the gemstones included in the matrix depicted in FIG. 34 are inlaid or encrusted.

FIG. 36 depicts an anterior view of the essential components of a time display device for use in a system in which calendar month information is indicated by the display of a precious material, hour information is indicated by an hour hand, and minute information is indicated by a minute hand.

FIG. 37 depicts an alternative matrix in which colors are uniquely assigned to months, except that these months are not calendar months but rather zodiac months.

FIG. 40A depicts a flowchart illustrating the process, typically to be executed by an electronic data processor running processing software to perform the depicted steps, by which sensory values detected by an environmental sensor are converted to outcomes, wherein each possible outcome is a different function.

FIG. 40B depicts a conversion chart in which received sensory values are mapped to certain outcomes according to the value sets into which potential sensory values can be grouped.

FIG. 40C depicts a group of example environmental sensors that can be used to detect sensory values that can then be converted to outcomes by the process depicted in FIG. 40A.

FIG. 40D depicts a group of example functions to which sensory value input can be mapped.

DETAILED DESCRIPTION OF THE INVENTION WITH REFERENCE TO THE DRAWINGS

Figure 1A:
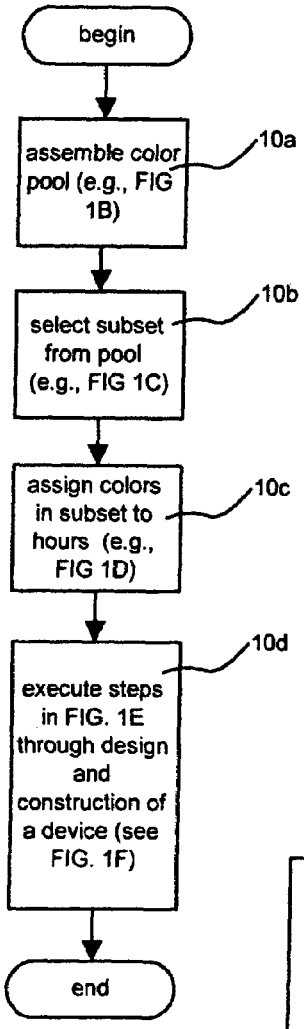
FIG. 1A depicts a flowchart illustrating the process by which a color-to-hour matrix is created and deployed.

DEFINITIONS: as used herein, "time display device" or "TDD" signifies any device which displays the time of day, including, but not limited to, video displays (e.g., LCD, LED, plasma, etc.); flat-panel and other electronic video displays and any object in which a color display can be embedded; wearable displays; wristwatches; key palettes; personal digital assistants (PDAs), personal information managers (PIMs), and other handheld computers; VCRs; car stereos; pagers; phones; wall, desk, grandfather, tower, alarm and water clocks; microwave ovens and other appliances; cable TV set-top boxes; and any other mechanical or electric device that includes a visible time display. It is further understood that each TDD includes a power supply sufficient to power its time display, data processing, data storage, and/or timekeeping functions, such as a battery, photovoltaic cell, self-winder, or power cord configured to plug into a wall outlet; a timekeeping device, such as a quartz or mechanical movement or a receiver for atomic clock radio frequency transmissions; and, if a liquid crystal display or other electronic display is used in the given TDD, sufficient data processing and storage (RAM/ROM) hardware to drive the electronic display, as well as any software necessary to serve that function and to render graphical images. It is further understood that each part of a TDD is made of a material appropriate to the function of that part; thus, plastic, metal, glass, synthetic materials, stainless steel, lubricant, quartz, silicon, leather, textiles, and other materials are used in the construction of the described alternative TDD's in accordance with known engineering principles and practices.

"Hour information" denotes the time of day information which typically appears to the left of the ":" in digital time format, or which is conveyed by an hour hand in a traditional analog clock.

"Active hour" denotes the particular hour information being presented as the "current hour of the day" at a particular moment in time by a time display device. For example, if the current time of day being displayed is 3:45 PM, then the active hour is 3, i.e., the current hour of the day.

"Minute information" denotes the time of day information which typically appears to the right of the ":" when the time of day is displayed in digital format, or which is conveyed by a minute hand in a traditional analog clock.

"Active minute" denotes the particular minute information being presented as the "current minute of the hour" at a particular moment in time by a time display device. For example, if the current time of day being displayed is 3:45 PM, then the active minute is 45, i.e., the current minute of the hour.

"Active month" denotes the month of the year being presented as the "current month" at a particular moment in time by a time display device.

"Color" denotes not only the "single frequency" colors of the rainbow, but any of the light phenomena that humans perceive and discern as color, including black (technically, an absence of light rather than a color), white (technically, a combination of all rainbow colors), gray (technically, a low brightness form of white), and brown (technically, a combination of certain rainbow colors).

"Hours of the day" denotes either the twenty-four hours in a calendar day or the twelve hours (1-12) indicated by a typical AM/PM clock, i.e., the twelve hours that appear on a typical analog clock face, each of which hours occurs twice per day. However, unless otherwise noted, the default understanding of "hours of the day" is the twelve hours depicted by a typical AM/PM clock. Similarly, "hour of the day" denotes one of the twelve or one of the twenty-four hours of the day, with the default meeting being one single hour of the twelve hours of an AM/PM day.

"Active hour image" denotes any electronically generated image that is of the color that represents the current hour of the day according to the color-to-hour matrix.

Section 1: The Color-to-Hour Matrix System and Method

The present invention provides an alternative time display system and method wherein hour information is conveyed through the display of color. Conveyance of hour information through color is made possible by a matrix (hereinafter a "color-to-hour matrix") in which colors are uniquely assigned to hours of the day. A time display device wherein this alternative time display method is used displays the color corresponding to the given active hour in a color-to-hour matrix in order to indicate the given active hour to an observer.

Figure 1B:
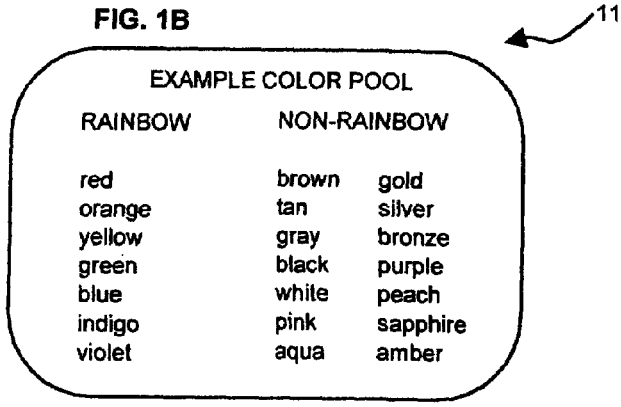
FIG. 1B depicts a group of colors, including rainbow colors, non-rainbow colors, and precious material colors, called a color pool.

A step-by-step method to create and implement a color-to-hour matrix appears in FIG. 1A. First, a pool of visible light phenomena which human beings typically consider to be separate and distinguishable colors and which meet certain inclusion criteria is assembled 10*a*, an example of which pool 11 appears in FIG. 1B; the primary criterion for inclusion in this pool is that a color be readily recognizable and distinguishable from other colors by a human being. One such pool may include black, white, red, orange, yellow, green, blue, violet, purple, brown, gray, tan, pink, gold, turquoise, amber, silver, and peach. Certainly, other pools are possible.

Figure 1C:
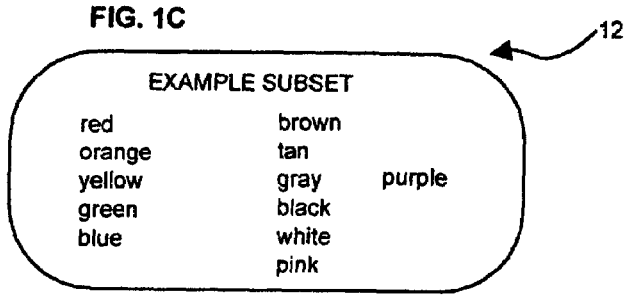
FIG. 1C depicts a group of colors that is a subset of the colors in the color pool depicted in FIG. 1B.

Second, from this pool, a subset of twelve colors is selected according to selection criteria 10*b*, an example of which subset 12 appears in FIG. 1C; selection criteria may include (1) the greatest likelihood of accurate recognition of a given color by an observer under a variety of lighting or atmospheric conditions, (2) the least likelihood of confusion of a given color with other colors in the given subset, and (3) the perceived attractiveness or prestige of a given color or its typical effect upon a viewer.

Figure 1D:
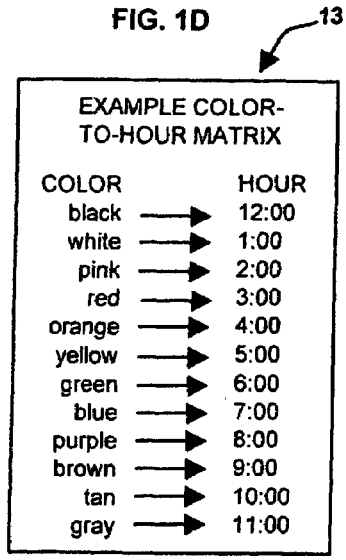
FIG. 1D depicts an example of the color-to-hour matrix that makes the disclosed color reference system possible.

Third, each of the selected colors is assigned to a particular hour of the twelve hours of a day 10*c*, thereby creating a sequence of colors, according to assignment criteria; assignment criteria may include (1) the "logic" of a given color following another color in the sequence, e.g., two adjacent colors are "opposites," such as black and white, (2) the distinctiveness or relatedness of a given color relative to those colors which immediately precede and follow it in the sequence, and (3) alliterative potential between the word for the color and the word for the hour, such as "one" and "white" or "ten" and "tan," such alliteration serving to make the color-to-hour matrix easier to remember. This assignment creates a color-to-hour matrix that provides a one-to-one relationship between each color in the subset and each hour of the day, an example of which color-to-hour matrix 13 appears in FIG. 1D.

The preferred embodiment of the color-to-hour matrix 13 as of the time of this writing is as follows:

Black=12:00 hour (12:00 to 12:59)
White=1:00 hour (1:00 to 1:59)
Pink=2:00 hour
Red=3:00 hour
Orange=4:00 hour
Yellow=5:00 hour
Green=6:00 hour
Blue=7:00 hour
Purple=8:00 hour
Brown=9:00 hour
Tan=10:00 hour
Gray=11:00 hour For the purposes of this disclosure, the above color-to-hour matrix is used in all examples except as otherwise noted, even though many other color-to-hour matrices are possible.

As a final step, a time display device that displays hour information by reference to the given color-to-hour matrix is constructed 10*d*. This device is designed and constructed according to the process in FIG. 1F to execute the two-step process depicted in FIG. 1E.

Figure 1E:
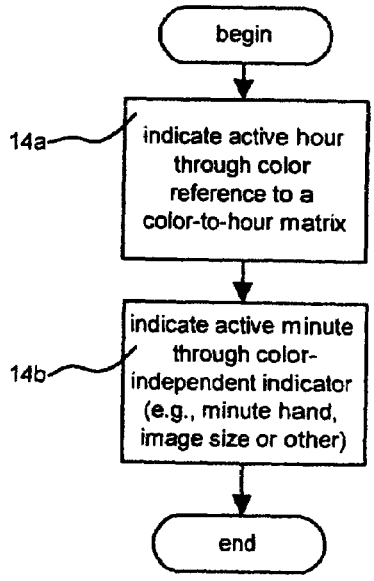
FIG. 1E depicts a flowchart illustrating the two-step process by which both the active hour and the active minute are indicated according to the present invention.

The steps of the process in FIG. 1E are: first, a color is displayed 14*a*, specifically, one of the colors in the color-to-hour matrix, and more specifically, the color which represents the active hour in the color-to-hour matrix; this display thereby indicates the current hour of the day. Second, the active minute is indicated 14*b* through any type of minute indicator, such as a minute hand, an hourglass, or any of the minute indicators disclosed below. Such minute indicators convey minute information without any reference to the color-to-hour matrix. The steps may be executed by person, a device, or multiple devices is working together.

The general process of designing and assembling the TDD is depicted in flowchart form in FIG. 1F. First, the purposes to be served by a proposed timepiece are examined, and a choice is made regarding whether a color-to-hour system timepiece is appropriate 15*a*; this decision may be made by reference to the color-to-hour system advantages depicted in the chart in FIG. 1H. Next, a housing appropriate to the purposes to be served by the proposed timepiece is chosen 15*b*; a chart of potential housings is depicted in FIG. 1G. Next, an hour indicator and a minute indicator are chosen 15*c*, with reference to the options in FIG. 1G. Next, a timekeeping mechanism is chosen 15*d*, with reference to the options and FIG. 1G. Once the design steps have been executed (which design steps may be performed in any order), the timepiece is constructed using the selected components according to the chosen design parameters and purposes. Clearly, the options depicted in FIG. 1G are a representative sample, not an exhaustive list.

Figure 2A:
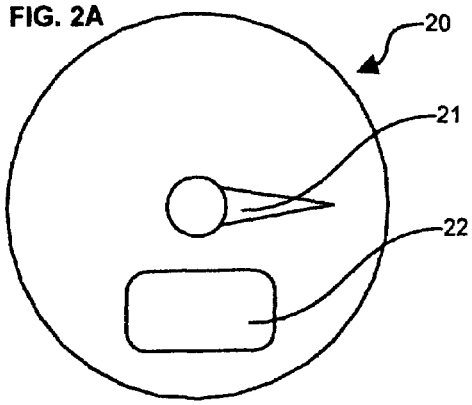
FIG. 2A and FIG. 2B depict an anterior view of the essential components of a time display device that executes the steps in FIG. 1E using a flat-panel display and a minute hand.

Section 2: The "Hybrid" Embodiment: Combining the Color-to-Hour Matrix Method with Prior Methods of Conveying Minute Information FIG. 2A depicts a time display device 20 that includes an electronic, full-color, flat-panel video display 22. As in the flat-panel display of a conventional digital watch or computer monitor, the depicted flat-panel display 22 displays hour information as kept by a timekeeping mechanism inside the TDD 20. However, instead of displaying a numerical digit or digits (e.g., "1") to indicate the active hour, this hour indicator 22 displays only a color, specifically, the color corresponding to the active hour according to the color-to-hour matrix; in other words, the hour indicator 22 displays a single graphical image that takes up the entire height and width of the display area, and this single image is essentially of a single color.

No other indication of the current hour of the day is displayed by the TDD 20, and yet by reference to the color-to-hour matrix, the hour indicator 22 conveys the current hour of the day with precision equal to that offered by a digit or an hour hand.

Thus, when the active hour is 1:00, the flat-panel display 22 displays the color white, which color corresponds to the 1:00 hour in the color-to-hour matrix. This color is displayed from the first second of the 1:00 hour through the last second of the 1:00 hour. At the top of the 2:00 hour, the flat-panel display 22 displays another color, namely, pink, the color corresponding to the 2:00 hour.

The TDD 20 also provides a minute hand 21, which, of course, conveys the active minute by orientation. Obviously, a second hand (not shown) can also be included.

Figure 2B:
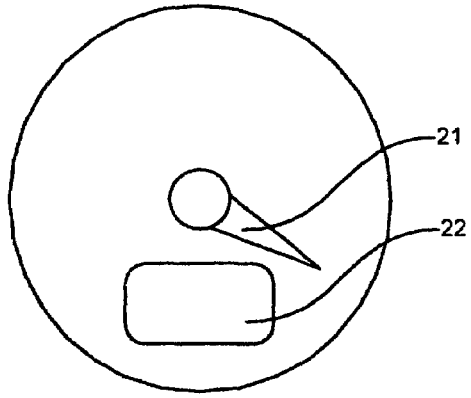

Thus, assuming that the color being displayed by the flat-panel display 22 depicted in FIG. 2A is brown, which color corresponds to the 9:00 hour in the color-to-hour matrix, and given the depicted position of the minute hand, i.e., pointing due right from the observer's perspective, the current time at the given moment depicted in FIG. 2A is 9:15. The time in FIG. 2B is approximately 9:20, again assuming that the color being displayed by the electronic display 22 is brown.

This hybrid embodiment has been specifically invented to facilitate rapid consumer acceptance by leveraging consumers' pre-existing time-telling skills. It offers all the accuracy and precision of a minute hand, all the accuracy and precision of an incremental hour indicator, the familiarity of the rotating clock hand approach, and the aesthetic advantages of a color-changing hour indicator as opposed to a monochromatic hour hand. Moreover, it can be read instantly by an observer —regardless of what language he speaks —and eliminates any possibility of confusion between hour hand and minute hand. Additionally, this embodiment is infinitely scalable: it can be used in a wristwatch-sized clock or in a Big Ben-sized clock. Given these attributes, this embodiment represents a potent alternative to conventional timepieces.

Figure 3A:
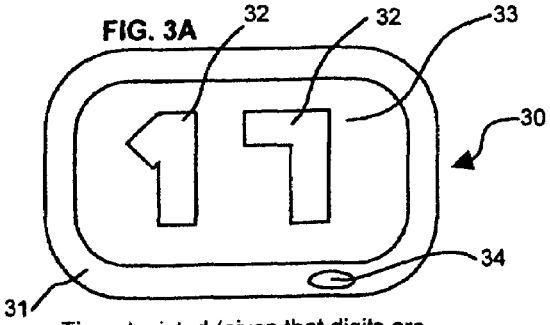
FIGS. 3A, 3B, and 3C depict an anterior view of a time display device that executes the steps in FIG. 1E using a flat-panel display that is configured to display the time in at least two different modes.

FIG. 3A provides another hybrid embodiment: a time display device 30 provides an electronic, color, flat-panel video display 31 through which minute information is displayed digitally such that one or two numerical digits 32 are graphically depicted as images in the display. Note that no ":" appears to the left of the minute information digits 32, and no hour information is conveyed numerically; hour information is conveyed solely by reference to the color-to-hour matrix; specifically, the color of the numerical digits themselves 32 indicates the given active hour. In short, these numerical digits 32 are active hour images that also convey minute information.

Thus, assuming that the color of the digits 32 being displayed by the TDD 30 in FIG. 3A (these digits being a "1" and a "7") are of the color gray, which color corresponds to the 11:00 hour, the time depicted at the given moment in time is 11:17. Note that the background 33 against which the images of the numerical digits 32 appear should be of a color or texture that facilitates easy reading of the numerical digits 32. This background image 33 can change over time, e.g., each time the active hour changes, or it can remain constant.

Figure 3B:
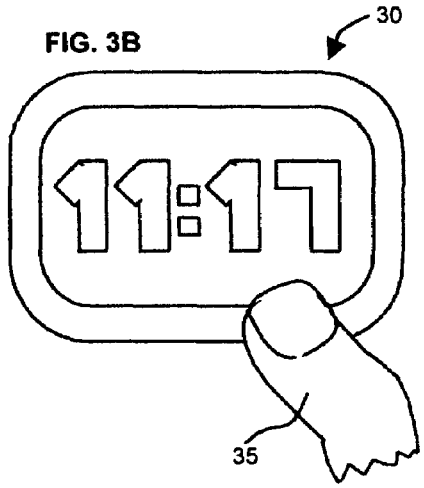

Note that an override button 34 is included on the time display device. When this button is depressed by the user's finger 35, the TDD 30 switches to a different time display mode according to the process depicted in FIG. 3D; in this second mode, the TDD 30 displays the time in conventional digital format, i.e., "11:17," as shown in FIG. 3B. This backup, conventional mode feature allows users new to the color-to-hour matrix a safety net: if they forget what hour a displayed color represents, they can simply switch the device 30 into conventional mode to get the current time.

Figure 3C:
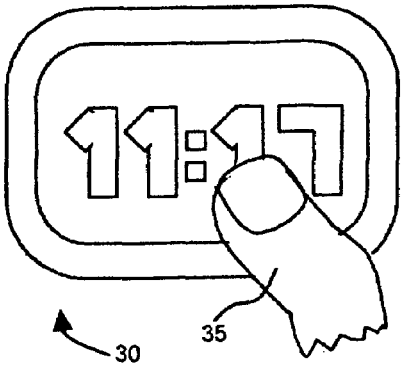

Alternatively, the screen of the flat-panel display can be touch-sensitive, like that of a Touch watch or Palm PDA. In this embodiment, when the screen is touched by the user 35 as shown in FIG. 3C, the same override effect is produced.

This particular hybrid embodiment 30 enjoys an inherent advantage over devices that display the time in conventional digital format: as depicted in FIG. 3A, the device 30 conveys both minute and hour information using only two numerical digits. Conventional digital format, however, requires four numerical digits and a colon character, five symbols in all as depicted in FIG. 3B. Thus, holding the size of the electronic display constant, the two digits required in the time display mode depicted in FIG. 3A can be displayed at a greater size than the five symbols required in the time display mode depicted in FIG. 3B, and can therefore be read at greater distances. Moreover, color is demonstrably easier to discern from a distance than is an individual alphanumeric character.

Figure 4:
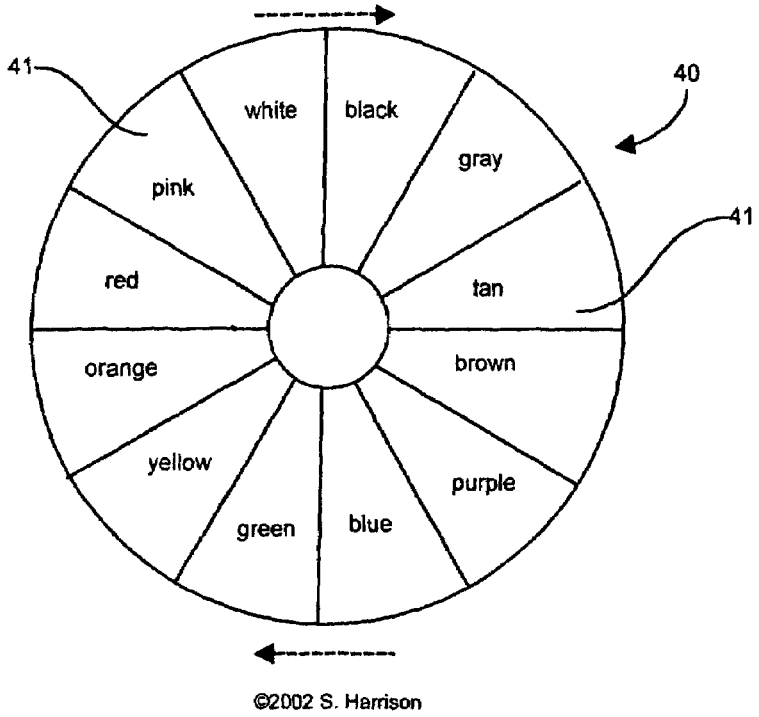
FIG. 4 depicts an anterior view of a multicolored dial that includes twelve different color segments.

The hybrid embodiment need not rely upon a flat-panel display. FIG. 4 depicts a color dial 40 with a multicolored surface; specifically, on the surface of this dial 40, twelve color segments 41 appear, each color segment 41 being made of or coated with a substance that reflects one of the colors in the color-to-hour matrix when exposed to white light (or, to be literally correct in the case of black, reflects substantially no light). The color segments 41 are arranged so that they follow the sequence of colors in the color-to-hour matrix in a counterclockwise fashion.

Figure 5A:
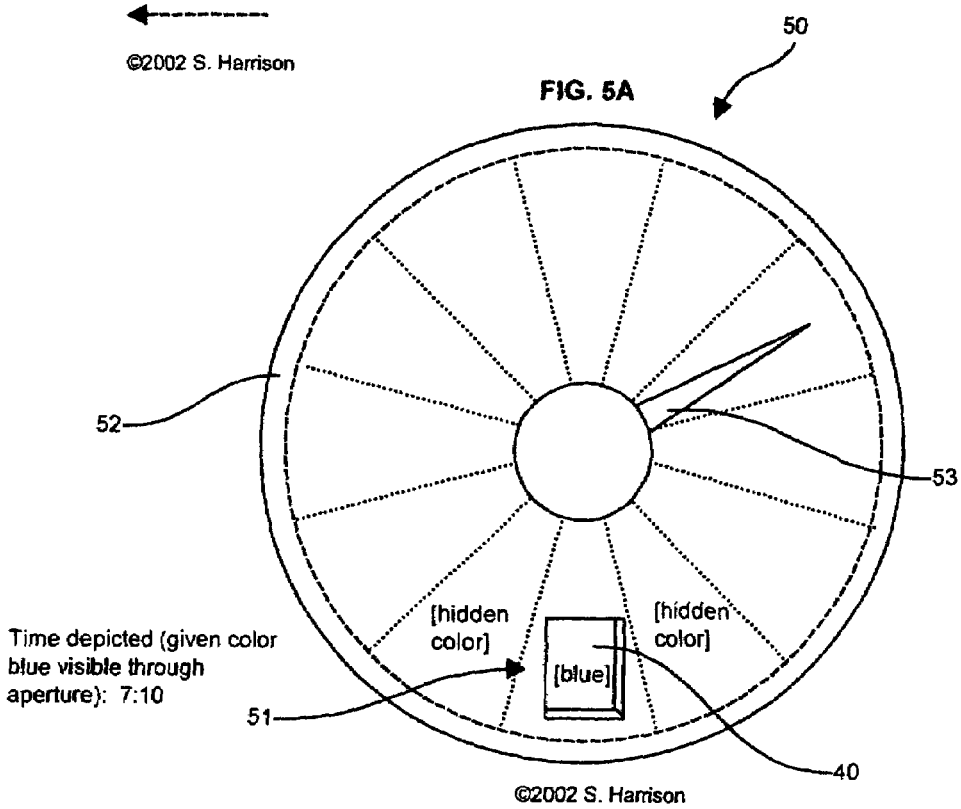
FIG. 5A depicts an anterior view of a time display device that includes the multicolored dial depicted in FIG. 4 but only reveals a portion of this dial so that the color of the revealed portion of the surface of the dial indicates which hour of the day is the current hour while a minute hand indicates current minute information.

FIG. 5A depicts a time display device 50 that includes a window or aperture 51 in the clock face 52. The color dial 40 can be partially seen through the aperture 51. A minute hand 53 also appears. The minute hand 53 moves at a constant rate of motion as is typical of clock hands; but the color dial 40 moves intermittently, specifically, only at the top of every hour, similar to the motion of a conventional "jump hour" watch. Thus, at the moment when the minute hand 53 completes an entire revolution around the clock face 52, the color dial 40 moves clockwise one-twelfth of a complete revolution, thereby revealing the next color segment 41 through the aperture 51.

Instead of the color dial moving, another embodiment provides that actual clockface moves. FIG. 5B depicts a clockface 55 with an aperture 56 through which a color dial 57 can be seen. The clockface 55 rotates in a clockwise fashion such that the aperture 56 moves intermittently, specifically, 1/12 of a complete revolution at the top of each hour. This movement serves the function of revealing a separate color segment of the color dial 57. Thus in FIG. 5B, assuming that the green segment of the color dial 57 is visible through the aperture 56, the active hour is 6:00, and the depicted time is 6:15. In FIG. 5C, assuming that the blue segment of the color dial 57 is visible through the aperture 56, the active hour is 7:00.

FIG. 5D depicts a watch 58 that includes a clock face, aperture, minute hand and color dial which can be seen through the aperture as well as a wrist strap, buckle and manual winding mechanism for setting the time.

As summarized in FIG. 5E, hybrid TDD's can be constructed so as to display the colors that represent hours through either an electronic display or a reflective dial mechanism. Meanwhile, minute information can be conveyed through either a minute hand or digit(s).

FIG. 5F summarizes the novel time communication system presented thus far: a TDD 58 displays the current time of day by displaying one of the colors in the color-to-hour matrix 13, specifically, the color that represents the current hour. A human observer 59 views the TDD 58, sees the color it displays, and then refers to the color-to-hour matrix 13 to find which hour is represented by that color. That hour is the active hour or current hour of the day. The current minute is indicated by minute hand or other minute indicator. The human observer can either commit the color-to-hour matrix to memory (which occurs naturally after a few days use) or can consult an electronic or hard document of this matrix.

Figure 6:
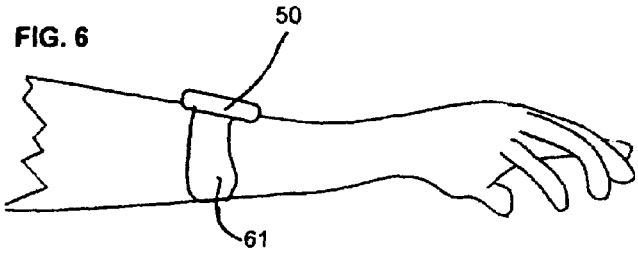
FIG. 6 depicts a side view of a wristwatch that includes a time display device according to the present invention.

FIG. 6 depicts a TDD like that in FIG. 5A when mounted on a user's arm by use of a watchband 61.

Figure 7A:
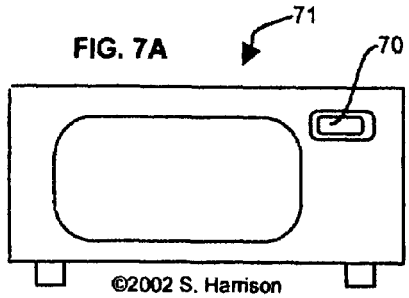
FIG. 7A depicts an anterior view of a microwave oven that includes a time display device according to the present invention.
Figure 7B:
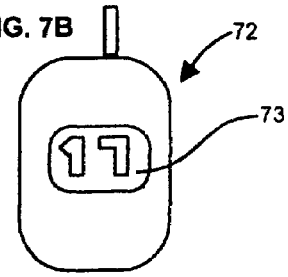
FIG. 7B depicts a posterior view of a mobile phone that includes a time display device according to the present invention on the back of the phone (keypad on front of the phone).
Figure 7C:
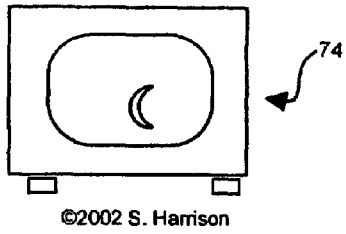
FIG. 7C depicts an anterior view of a television that includes a time display device according to the present invention.

FIG. 7A depicts a TDD according to present invention 70 embedded in a microwave oven 71. FIG. 7B depicts a cellular phone 72 in which is embedded such a TDD 73 (time displayed per mode in FIG. 3A). FIG. 7C depicts a television 74 currently displaying the time according to the present invention (per mode in FIG. 11A).

Figure 8:
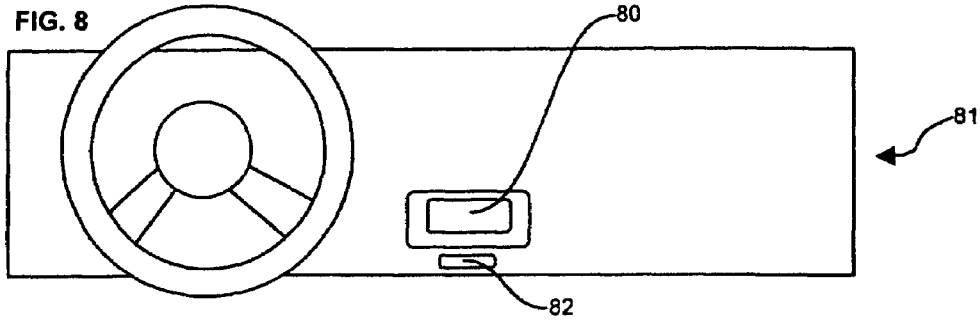
FIG. 8 depicts an anterior view of an automobile dashboard that includes a time display device according to the present invention.

FIG. 8 depicts a TDD 80 embedded in the dashboard 81 of an automobile. An infrared port 82 for wireless exchange of data between the TDD 80 and an external computer for use in the data exchange processes described below is also built into the dashboard 81.

Figure 9A:
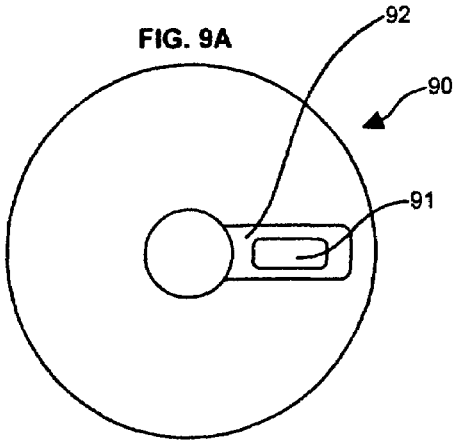
FIG. 9A depicts an anterior view of a time display device whereof the minute hand includes a flat-panel display that displays a color in the color-to-hour matrix to indicate the current hour of the day.
Figure 9B:
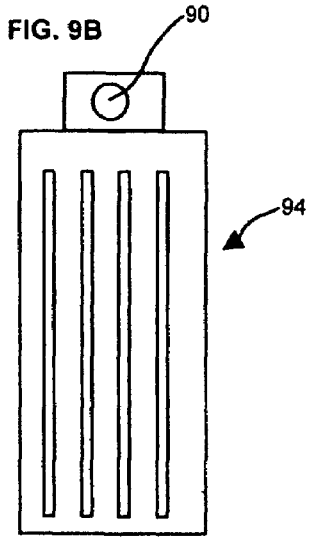
FIG. 9B depicts an anterior view of an office building that includes a location where a time display device such as that depicted in FIG. 9A can be embedded.

FIG. 9A depicts a time display device 90 in which an electronic display 91 is mounted upon the minute hand 92. As in the other embodiments, hour information is conveyed by color displayed by the display 91, and minute information is conveyed by the position of the minute hand 92. FIG. 9B depicts a position where the TDD 90 can be embedded in an office building 94.

Section 3: Communicating Minute Information through Features of the Appearance of Graphical Images Minute information can be conveyed by way of a computer-animated image whereof a certain variable feature, such as shape, size, complexity, or speed, changes throughout the course of an hour according to a predictable pattern, then returns to its original state at the top of the next hour, and then repeats the same change pattern. Each such pattern is called a "feature sequence." Below are several novel time display modes that combine the color-to-hour reference method of hour indication with the feature sequence method of minute indication.

a. Feature Sequence in which Minutes are Shown by Size

Figure 10A:
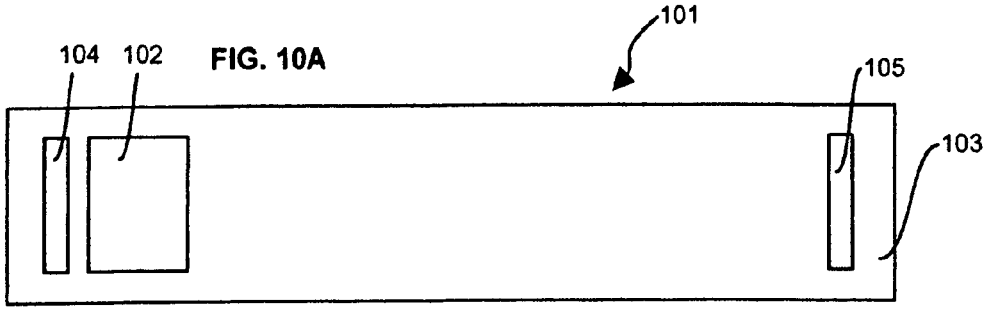
FIG. 10A and FIG. 10B depict a "screenshot" of the graphical output of a color, flat-panel video display, this graphical output being several graphical images, one of which is the active hour image, which indicates the active hour by way of color by reference to the color-to-hour matrix, and indicates the active minute by size of the image itself; this combination of novel methods of conveying hour information and minute information is called a time display "mode," and several different time display modes appear in the following figures.

FIG. 10A depicts the graphical output of a flat-panel display 101 (this Figure is essentially a "screen shot," meaning, that the flat-panel display housing, etc., is not depicted; rather, only the image content being displayed by the flat-panel display is depicted). At the moment in time depicted in FIG. 10A, an active hour image 102, a background image 103, a preceding hour image 104, and an upcoming hour image 105 appear. The active hour image 102 is a rectangular block of color; the color of this rectangle 102 is the color uniquely assigned to the hour of the day that is the active hour at the depicted moment in time. The preceding hour image 104 is of the color assigned to the hour that immediately preceded the active hour. The upcoming hour image 105 is of the color assigned to the hour that will immediately follow the active hour.

Thus, as in other embodiments, if the active hour image 102 is white, the active hour is 1:00, meaning that the time being displayed by the flat-panel display 101 is between 1:00 and 2:00 (including 1:00 but not 2:00). The background image 103 may be a solid color, a textured "wallpaper", a photographic image or any other image which can be visually distinguished from the active hour image 102 by a human viewer.

Figure 10B:
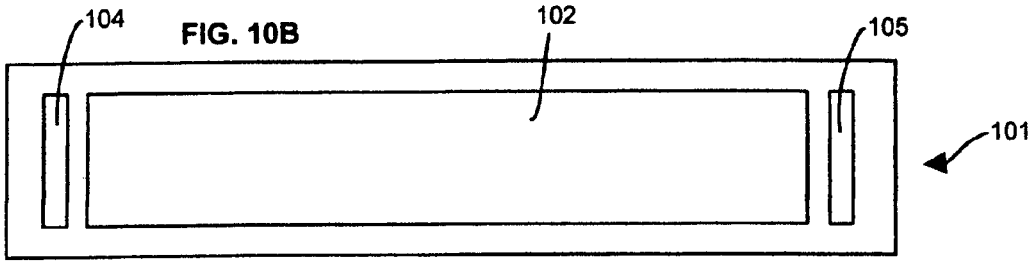

By computer animation, such as that used in a Macromedia Flash movie, the active hour image 102 grows incrementally wider throughout the passing of the hour. At the beginning of the hour, the active hour image 102 is but a narrow vertical line; at the end of the hour, the image 102 is wide enough to take up most of the space between the preceding hour image 104 and the upcoming hour image 105. FIG. 10B depicts the maximum width the active hour image 102 will attain, i.e., at approximately fifty-nine minutes past the hour. To tell the time, the viewer must simply make an approximation of the time by looking at the current width of the active hour image 102 and comparing its width as currently displayed to the width this image 102 will attain just before the end of the hour; the resulting ratio represents how much of the active hour has elapsed. Thus, if the active hour image 102 is half as wide as it will be at fifty-nine minutes past the hour, then the current time is approximately half past, i.e., 30 minutes past, the top of the active hour.

The time depicted in FIG. 10A, assuming that the color of the active hour image 102 is white, is approximately 1:10. The time depicted in FIG. 10B, assuming that the color of the active hour image 102 is white, is approximately 1:59.

At the moment a new active hour begins, the color of the active hour image changes to the color that represents the new active hour, and the size of the active hour image changes to approximately one sixtieth (1/60) of the maximum width that the active hour image can attain.

For people with color discernment disabilities, e.g., color-blindness, a letter corresponding to the first letter of the word that denotes a given color can be included in the active hour image 102, or a unique shape or texture, such as a jagged edge or a star, made part of the active hour image 102, so as to distinguish the given color from another color likely to be confused with the given color. These color discernment aids are not depicted.

It is suggested that the background image be marbleized or texturized rather than one solid color; this image complexity will make it easier to discern the solid hour images from the textured background. Additionally, it is recommended that the hour images include a border, perhaps only one or two pixels wide, that is white so that lighter colors, such as tan and gray, can be recognized as such rather than confused with white; any border of any color can be used to enhance the visual attractiveness of the active hour image so long as this border does not confuse the observer as to what the actual active hour color is. Also, making the active hour image pulsate or otherwise include some form of motion may make discernment of the active hour image easier.

b. Minutes Shown by Shape of Image

Figure 11A:
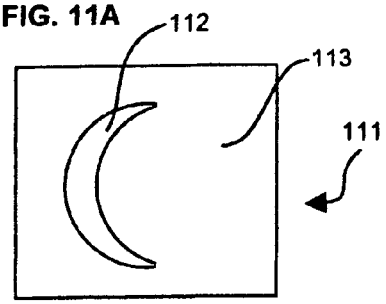
FIGS. 11A and 11B depict screenshots in which an active hour image appears that indicates minute information by shape.

FIG. 11A depicts the graphical output of a flat-panel display 111. The active hour image 112 appears against a background image 113. The active hour image 112 changes shape as the active hour elapses; this change in shape follows the visual cycle of a waxing moon, i.e., beginning as a tiny sliver of an arc at the top of the cycle then progressively growing to a crescent moon, then to a half moon, then to a three-quarters moon, and ending as a full moon.

To tell the time, the user looks at the shape of the active hour image 112 and determines where in this "moon" cycle the given shape falls. At 15 minutes past the hour, the active hour image will be a crescent; at half past the hour, the active hour image will be a half-circle; at approximately fifty-nine minutes past the hour, the active hour image will be a full circle.

Figure 11B:
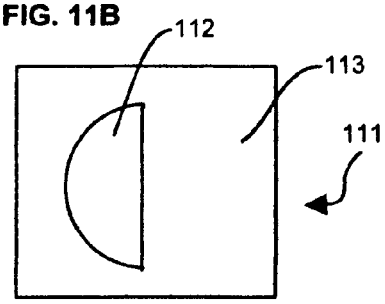
Figure 12A:
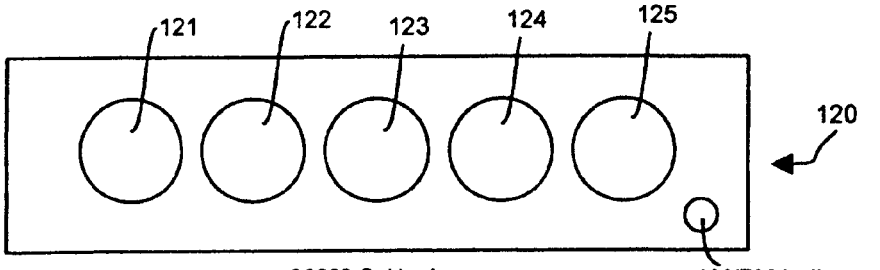
FIGS. 12A and 12B depict screenshots of a different time display mode, one in which minute information is conveyed by the number of images displayed.

Assuming that the active hour image 112 depicted in FIG. 11A is blue, which color corresponds to the 7:00 hour, the crescent shape of this image 112 indicates that the time displayed in FIG. 11A is approximately 7:15. Again assuming that the active hour image 112 is blue in FIG. 11B, the time depicted in FIG. 11B is 7:30.

c. Minute Information Conveyed by Successive Appearance of Images Representing Blocks of Time that Have Elapsed Since the Beginning of the Current Hour FIG. 12A depicts the output of a flat-panel display 120. At the depicted moment in time, several images appear 121-125, each of which represents a 10-minute block of elapsed time during the active hour. Assuming that the circles are of the color blue, which color corresponds to the 7:00 hour, the active hour in FIG. 12A is 7:00. Since there are five circles and each circle represents a 10-minute block of time that has elapsed since the top of the hour, the time displayed is between 7:50 and 7:59. Since elapsed time in this method is displayed in units representing 10 minutes per unit, the viewer cannot tell from this display alone what the time is with any more precision than a 10-minute time frame. Any shape can be used instead of a circle, such as a heart, a smiley-face, or a company logo.

Figure 12B:
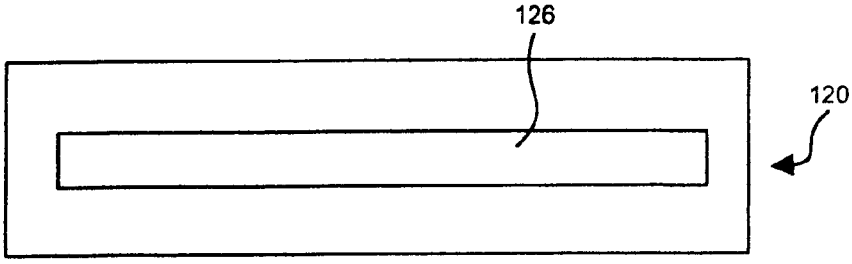

Note that at the top of an hour, before any 10-minute blocks of time have elapsed in that hour, a solid horizontal line image 126 of the color of the new active hour bifurcates the display, as depicted in FIG. 12B.

Alternately, a color-to-hour matrix in which 24 colors are assigned to 24 hours of the day (not pictured) can be conceived, thereby eliminating the need for an a.m./p.m. indicator, such as that which appears in FIG. 12A.

d. Minutes Shown by Amplitude of a Graphical Waveform Image

Figure 13A:
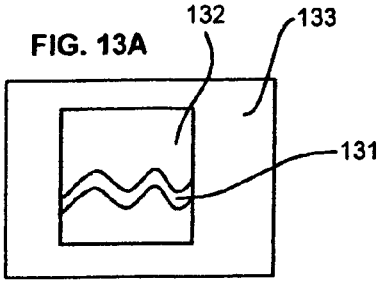
FIGS. 13A and 13B depict screenshots of a different time display mode, one in which minute information is conveyed by the amplitude of a waveform image.
Figure 13B:
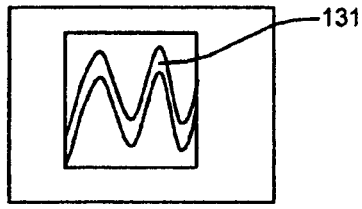

FIG. 13A depicts a time display mode wherein amplitude takes the place of a minute hand: a line image 131 of the color of the active hour appears in a square image 132 which is set against a background image 133. The line 131 is in continual motion as though it were a graphical representation of a sound wave. The frequency of the wave does not change, but as the time progresses through an hour, the amplitude grows. Thus, in FIG. 13B the amplitude of the line wave 131 is greater. By the end of the hour, the amplitude of the image 131 will be so great that the extreme points of the wave reach the top and bottom limits of the square 132. At the top of the next hour, the line becomes a flat line, and the process of gradually increasing amplitude resumes.

e. Minutes Shown by Visual Complexity

Figure 14A:
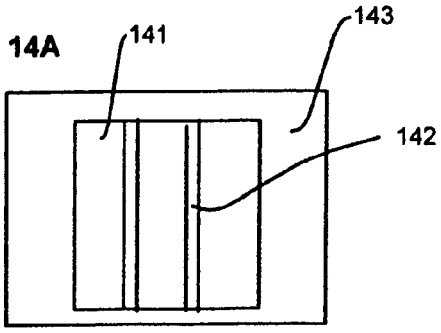
FIGS. 14A, 14B, and 14C depict screenshots of different time display modes in which minute information is conveyed by image complexity.

FIG. 14A depicts a display mode in which successive partitions of a shape take the place of a minute hand: an image 141, of the color of the active hour, begins the hour as a plain geometric shape, namely, a square in the depicted example, which is set against a background image 143. After 10 minutes have passed, an image of a line 142, splits the square 141 into two pieces. After 10 more minutes have passed, another line appears, splitting the square into three pieces. Thus, in FIG. 14A, the square 141 has been divided into three rectangles, indicating that the time is somewhere 20 and 29 minutes past the hour.

Figure 14B:
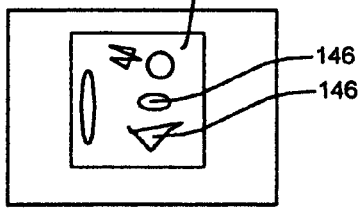
Figure 14C:
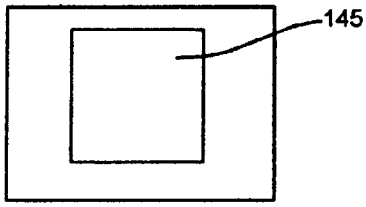

FIG. 14B depicts a different display mode in which complexity takes the place of a minute hand: at the top of the hour a plain square 145 of the color of the active hour is displayed (as in FIG. 14C). Every five minutes, a new shape 146 appears in the square 145 making the overall visual appearance of the contents of the display more complex. Thus, the time displayed in FIG. 14B, in which five shapes have appeared in the square, is between 25 minutes after the hour and 30 minutes after the hour.

f. Minutes Shown by Position or Relative Distance Between Two Points

Figure 15:
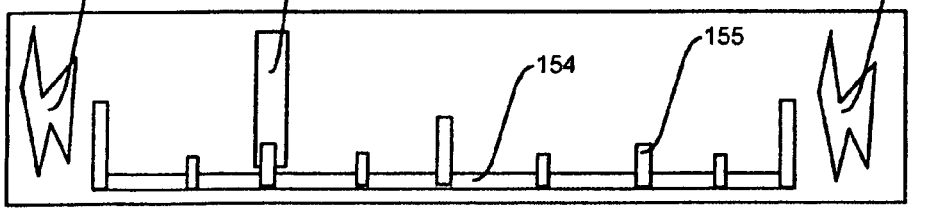
FIG. 15 depicts a screenshot of a different time display mode, one in which minute information is conveyed by the position of an image relative to other images.

FIG. 15 depicts a different mode of conveying minute information in which a preceding hour image 151 appears to one side of the active hour image 152. The active hour image 152 moves as time passes throughout the hour, thereby increasing the distance between the active hour image 152 and the preceding hour image 151, which is in this example a company logo, while closing the distance between the active hour image 152 and the upcoming hour image 153, which is the same company logo.

The upcoming hour image 153 and preceding hour image 151 can be any type of image, such as a heart. Images which play a functional role in the depiction of hour or minute information, such as an active hour image or upcoming hour image, are called "foreground images." The shape of these images can be selected by the user per the user-configuration processes described below. Also, a ruler line 154 appears in FIG. 15, featuring interval marks 155 that break the hour down into smaller units so that a viewer can ascertain the current time with greater precision.

g. Minutes Shown by Images Appearing on Multiple Displays Working Together

Figure 16:
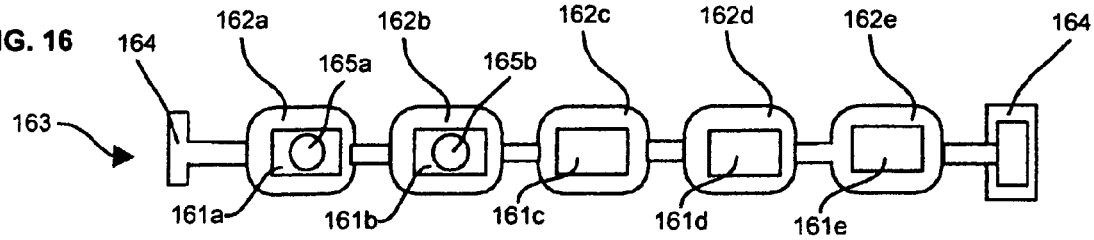
FIG. 16 depicts an anterior view of a bracelet in which several electronic displays are communicatively coupled to one another so as to display time information in cooperation with each other.

FIG. 16 depicts a device that includes multiple electronic displays 161*a*-161*e* mounted in individual housings 162*a*-162*e* which are jointed together so as to form a bracelet 163, which includes a fastener 164 on each end of the bracelet 163. The electronic displays 161*a*-161*e* are communicatively coupled electrically so that they can function in cooperation. The time display method used is essentially the same as that depicted in FIG. 12A except that, instead of each 10-minute circle being displayed by the same display, each circle 165*a*-165*b* is displayed by a different display 161*a*-161*e* in the bracelet 163. Thus, in FIG. 16, since a circle 165*a* and 165*b* is displayed in each of the first two displays 161*a* and 161*b* while the remaining displays 161*c*-161*e* show no image, the time is between 20 minutes and 29 minutes after the hour.

h. Minutes Shown by Motion

Figure 17A:
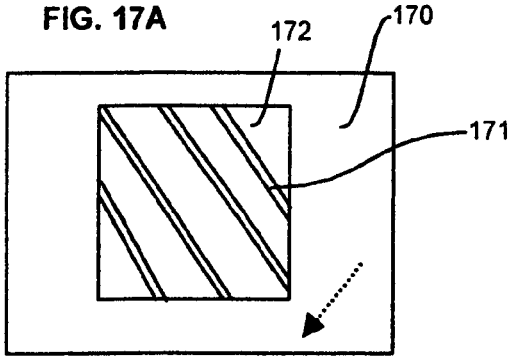
FIGS. 17A and 17B depict screenshots of a different time display mode, one in which minute information is conveyed by the speed of motion.
Figure 17B:
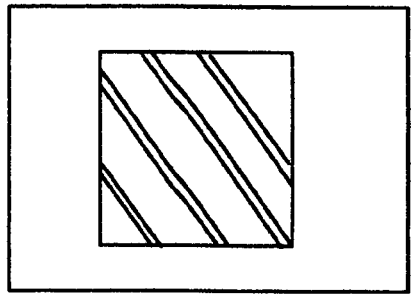
Figure 18:
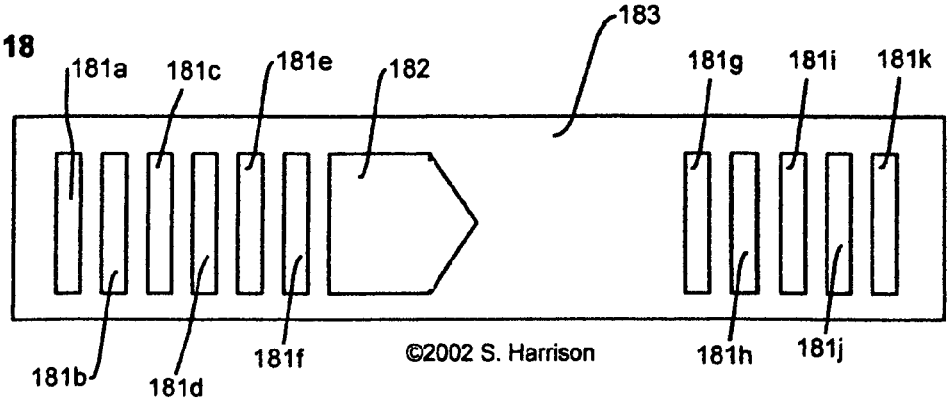
FIG. 18 depicts a different time display mode, in which minute information is conveyed by the size of an active hour image and the other eleven hours of the day are represented by separate images.

FIG. 17A depicts another display mode, in which relative speed takes the place of a minute hand: parallel lines 171 appear in a square 172 of the color of the active hour. These lines move through the square 172 in the direction indicated by the motion arrow that appears in FIG. 17A. At the top of the hour, these lines 171 move very slowly. By the end of the hour, they move very rapidly. FIG. 17B, just a second after the moment in time depicted in FIG. 17A, shows these lines 171 after they have moved. In this way, minute information is conveyed—intentionally imprecisely —simply by the speed of the lines.

i: Minutes Shown by Size of an Image, and Images Representing Each Hour of the Day Also Shown FIG. 18 depicts another time display mode. Several graphical images are being displayed by a flat-panel display, including several hour images 181*a-k*, the active hour image 182, and the background image 183. Each hour of the day (one o'clock through twelve o'clock) is represented by an image: the one o'clock hour is represented by the bar image 181*a* appearing at the far left; this image 181*a* is of the color that corresponds to one o'clock hour, namely, white. Just to the right of that is the bar image 181*b* that corresponds to the two o'clock hour. The seven o'clock hour is represented by an image 182 that looks different from the other images that represent hours 181*a-k*. This difference derives from the fact that the actual time of day is between seven o'clock and eight o'clock at the particular moment in time depicted by FIG. 18, i.e., the active hour is the seven o'clock hour, thus the active hour image 182 is the seventh image from the left and is of the color blue.

The image 182 that represents the active hour grows wider throughout the hour, similar to the active hour image depicted in FIG. 10A, expanding only in one direction, namely, toward the image 181*g* that represents the eight o'clock hour.

j: Minutes Shown by Apparent Fullness/Emptiness of a Virtual Container

Figure 19A:
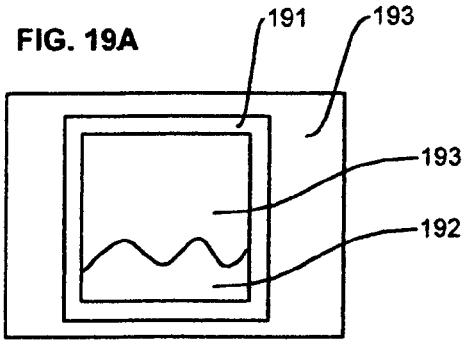
FIGS. 19A, 19B, and 19C depict screenshots of a different time display mode, one in which minute information is conveyed by apparent fullness/emptiness of a virtual container.
Figure 19B:
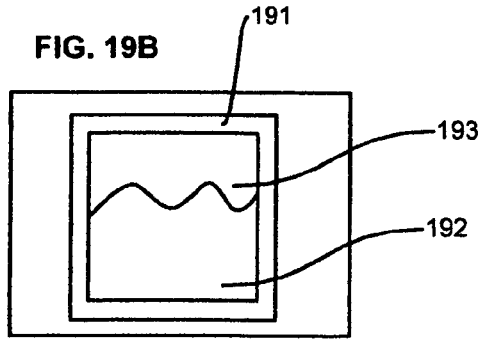
Figure 19C:
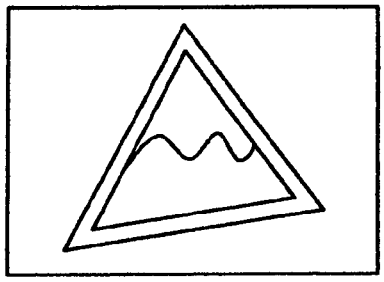

FIG. 19A depicts a time display mode in which relative fullness/emptiness of a simulated container takes the place of a minute hand: a frame image 191 encloses the active hour image 192 that appears to be a wavy liquid; beside and between these images appears the background image 193. As time passes, the simulated liquid of the active hour image 192 gets higher in the frame 191, as depicted in FIG. 19B. Thus, if the simulated liquid 192 is blue in color, the time displayed at the moment depicted in FIG. 19A is approximately 7:15; the time displayed in FIG. 19B is approximately 7:45. At fifty-nine minutes past the hour, the active hour image will appear to fill the frame image. Other shapes for the frame can be used, such as a triangle, as in FIG. 19C.

Section 4: User-Configurable Display

An embodiment of the present invention allows the user to manipulate certain features of the appearance of the time display device. This user control is made possible by enabling the TDD to be connected to an external computer for synchronization of data.

A basic TDD according to the user-configurable embodiment of the present invention resembles a PDA in that it includes the following components: (1) a flat-panel display; (2) data processing and storage hardware sufficient to drive the display and run software; (3) software for depiction of graphical images through the flat-panel display; (4) an internal timekeeping mechanism or a radio frequency receiver equipped to retrieve current time information from an external source; (5) batteries or other power source; and (6) a data exchange port configured to connect to a docking station in such a way as to allow data exchange between the TDD and an external computer.

For the purposes of the remainder of Section 4 of this disclosure, it is assumed that the TDD is a PDA similar to the Palm PDA from Palm Computing. This assumption is for convenience and ease of illustration only; user-configurable devices according to the present invention can be made in virtually any shape or size.

Figure 20:
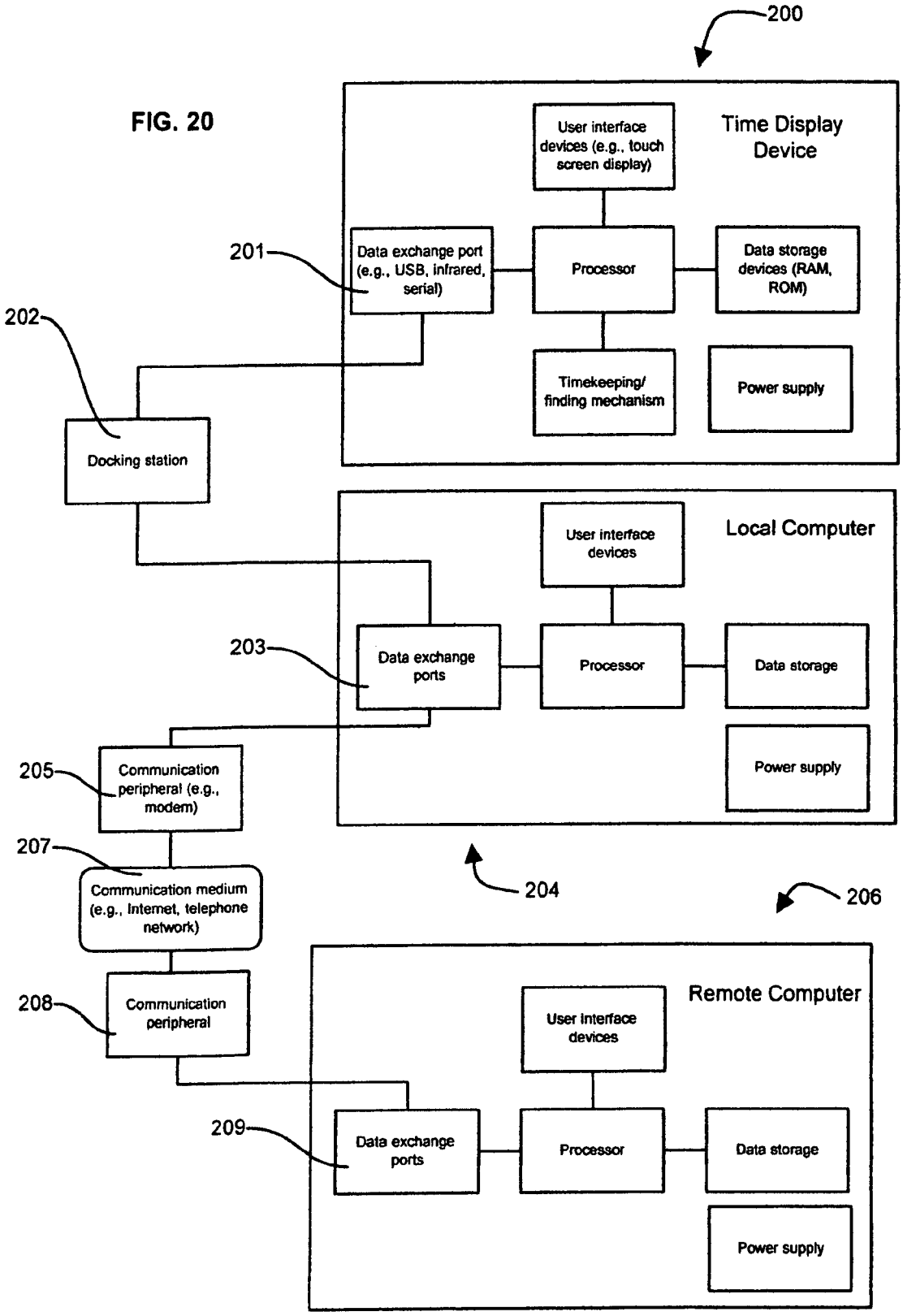
FIG. 20 depicts a schematic overview of the components of a system whereby a user can configure the appearance of a time display device using an external computer with access to a remote computer.

FIG. 20 depicts a schematic overview of the manner in which a typical PDA connects to a local computer and a remote computer for the synchronization of data. The PDA/TDD 200 includes a data exchange port 201 configured to couple to a docking station 202 so as to establish a data link for the exchange of electronic information between the PDA/TDD 200 and the docking station 202. This docking station 202 connects to the USB port or similar data exchange port 203 of a local computer 204, such as a desktop or laptop. This docking station 202 may also be plugged into a standard wall power outlet so that when the user-configurable TDD is in the docking station, the batteries in the device can be recharged.

The local computer 204 also includes a communication peripheral (internal or external) 205, such as a cable modem, through which the local computer 204 can access a communication medium 207 such as the Internet. By way of this medium 207, the local computer 204 can also exchange electronic data with a remote computer 206, which is also connected to the Internet 207 by way of a communication peripheral 208 through a data port 209.

Once these data links are established, data which is stored in the memory of the TDD 200, the local computer 204, and a remote computer 206 can be synchronized through one or more of the known methods of data synchronization, such as the synchronization methods used in HotSync software from Palm, which synchronizes data on the TDD 200 and the local computer 204, and IntelliSync software, which synchronizes data on the TDD 200 and the remote computer 206, thereby using the local computer 204 primarily simply as a conduit. Data is modified by a user through standard means, such as manual input of data through a user interface device such as a keyboard, and then synchronized between the three units upon activation of the synchronization function by the user, which can be done through a hardware button, such as that which appears on a Palm docking station, or a software menu selection, such as that which appears in HotSync software.

Figure 21:
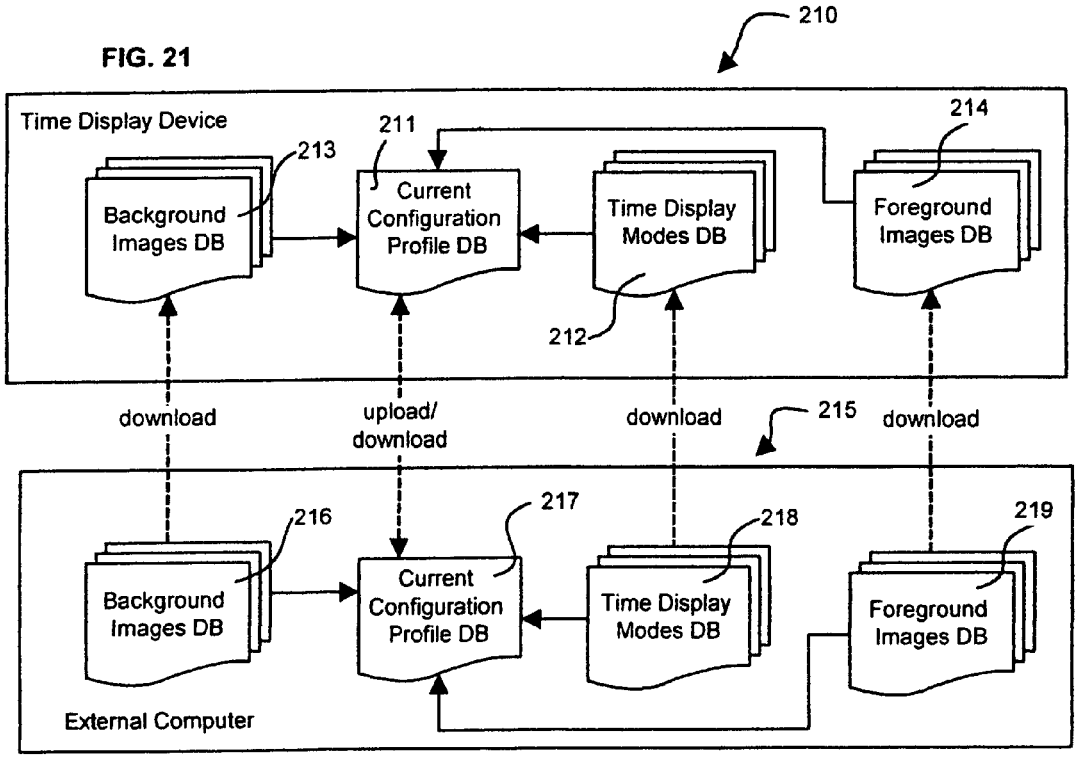
FIG. 21 depicts a schematic overview of the databases stored in the memory of a user-configurable time display device and in the memory of an external computer for use in the user configuration of the time display device.

As depicted in FIG. 21, stored in the memory of the TDD 210 is a series of databases containing configuration data according to which configuration settings the TDD displays the time. One database consists of a single record, which is the current configuration profile 211 of the time display device. The fields in this record include:

Standard Display Settings:
- brightness
- contrast
- hue
- color saturation
- color balance (e.g., RGB)
  - etc.

Time Display Preferences:
- time display mode
- background image
- foreground image The time display preference fields reference three additional databases: the background images database 213, the time display modes database 212, and the foreground images database 214. The background images database 213 includes any number of image files (e.g., JPEG), one of which is identified in the current configuration profile 211 as the image to be displayed as the background image by the TDD. The time display modes database 212 includes several records, each containing the code (e.g., graphical animation) necessary for portrayal of minute and hour information according to one of the time display modes described herein or developed hereafter; one of these records is identified in the current configuration profile 211 as the mode currently being used by the TDD in displaying the time. The foreground images database 214 includes any number of image files, one of which is identified in the current configuration profile as the image to be used in conjunction with a given display mode if the given display mode calls for the incorporation of an image into the actual portrayal of time information, e.g., the use of a company logo.

Each database on the TDD has a counterpart in the external computer 215: a background images database 216, a current configuration profile 217, a time display modes database 218, and a foreground images database 219. Data in these counterpart databases may be synchronized as indicated in FIGS. 21 and 22.

Figure 22:
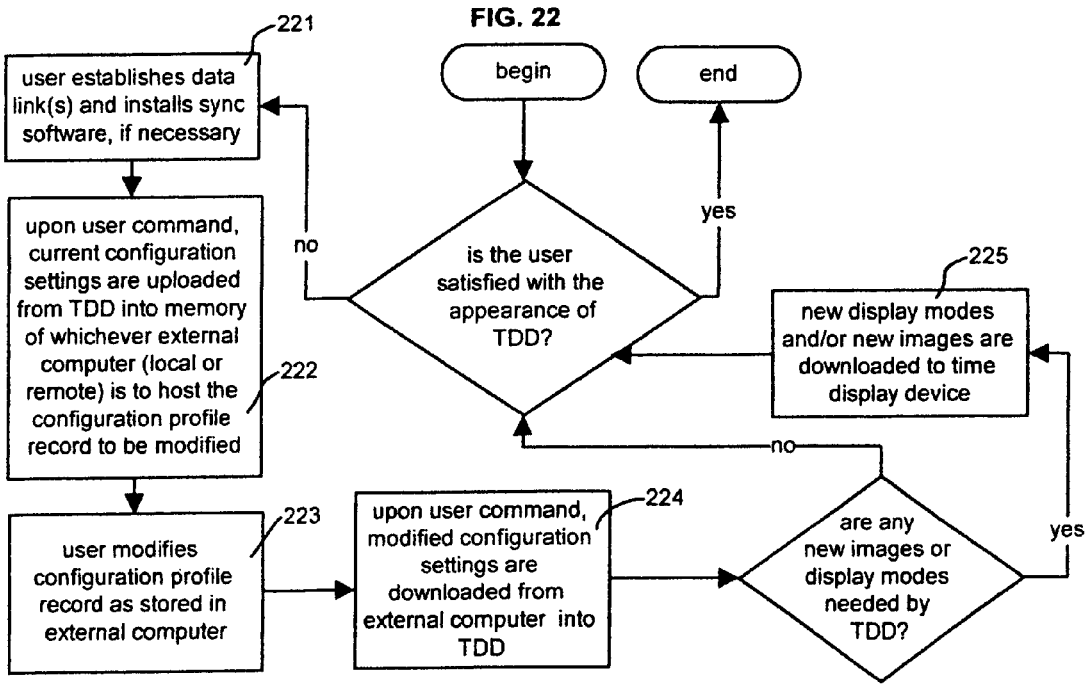
FIG. 22 depicts a flowchart illustrating the process by which a user configures the appearance of a time display device.

If a user wishes to alter the appearance of his TDD using an external computer, he follows the steps of the process depicted in FIG. 22. First, the user establishes the necessary data links between the TDD and one or more external computers 221. If any synchronization software needs to be installed in order to enable data synchronization between the devices, installation is done at this time 221. Then the user synchronizes data between the units such that the current configuration profile is uploaded from the TDD into the external computer where it can be modified 222. Then the user makes whatever changes he wishes to make to the current configuration profile using the external computer 223. The modified current configuration profile is then downloaded to the TDD by data synchronization 224, along with any image or display mode files that the TDD lacks 225.

When information in the current configuration profile record 211 has been changed, the TDD displays the time according to the new configuration settings, referencing old or new files in the background images database 213, the time display modes database 212, and the foreground images database 214.

FIG. 23A depicts an example of the user interface through which the user makes changes to configuration information by accessing a remote computer. Depicted therein is a portion of a web page called the "Configuration Profile Modification Page", which provides a control panel through which the user can control general settings for the display, e.g., brightness, contrast, etc., as well as choose a different time display mode. Any of the time display modes described above susceptible to being rendered on a flat-panel display can be chosen by the user, as well as any such modes developed after this writing. Similarly, a background image can be selected by the user for use by the TDD, including new images that the user would like to add to the background images database: as indicated in the example in FIG. 23A, the user simply provides the file path of the desired background image and then clicks the "submit" button to submit the form and add this background image to the background images database.

Typical HTML tags used in a web page form by which information is submitted to a remote server computer are well-known in the art, such as:

```
<FORM ACTION="example.htm" METHOD=POST>
Brightness:
<INPUT TYPE=text NAME=brightness VALUE=" "
  SIZE=25 MAXLENGTH=60>
<INPUT TYPE=submit NAME=submit VALUE="send
  message">
```

Some time display methods require additional choices to be made by the user; if necessary, the user makes these additional selections from the "Additional Selections Page"; an example of a portion of this web page appears in FIG. 23B. For instance, if the time display method depicted in FIG. 15 is chosen, the Additional Selections Page appears prompting the user to choose whether a ruler line should be displayed below the active hour image.

After all selections have been made, the user's browser is directed to the URL for the "Download/Synchronize Information Page"; an example of a portion of this web page appears in FIG. 23C. Through this page, the user can download the necessary synchronization software, if he has not already done so, and then download the chosen configuration information through the local computer to the TDD.

Alternately, modifications to the configuration settings of the TDD can be done in the local computer or by manual, speech, or touch interface with the TDD itself. However, the Internet-enabled approach offers some advantages: (i) the user can change configuration of the TDD from almost anywhere so long as he can establish a data exchange link between the TDD and a computer that has Internet access; (ii) any time a new time display mode is developed, this new mode can be made immediately available worldwide.

Also, a docking station is not necessary for information exchange; information can be beamed wirelessly to a TDD via infrared port or other wireless data exchange mechanism.

FIG. 24A depicts additional databases used in a remote computer to manage the process of user configuration via Internet. The remote computer, a server configured to respond to HTTP requests, includes a Users Database 242 of records pertaining to registered users. A user registers to create a unique record in this database 242, a "user account", maintained to identify that user when he accesses the site. Thereafter, each time the user visits the given web site, he logs in by use of a user name and password, and a unique identifier called a "session cookie" is transmitted to the user's local computer, which essentially singles out that given user's record from all others by uniquely identifying the local computer as the one that the given user is using during this Internet session. All Internet sessions and session cookie identifiers are maintained in a Current Sessions Database 246, and the unique session 241 which identifies a given user represents the single record assigning a given session to a given record in the Users Database 242.

When a user accesses his user record in the users database 242, he identifies what type of time display device he owns. This field in the given user record in the Users Database 242 is used in a relational database relationship as a key to a particular record in the Hardware Device Profiles Database 243. The Hardware Device Profiles Database 243 contains a record for each type of TDD, including which display modes are available for use on the given device and which driver software is needed to exchange data between that type of device and a computer. These latter fields are related to records in the Display Modes Database 245 and the Software Drivers Database 244.

FIG. 24B depicts a number of the display mode options from which a user could choose in the Display Modes Database 245. The depicted list of options is not exhaustive, and additional display modes can be added as new records to the Display Modes Database 245 as soon as they are created.

Section 5: Conveying Hour and Minute Information Through Projection of Colored Light upon Reflective Physical Objects The color-to-hour reference system also enables the use of actual physical objects as minute information indicators in unprecedented ways. These alternative embodiments are made possible by the projection of colored light upon objects that typically appear white when exposed to white light, so that these objects reflect the color of the light projected upon them.

NOTE: in the following alternative embodiments using projected light, the sequence of the color-to-hour matrix is altered so that projector-unfriendly colors, such as black, are replaced with other colors, such as violet and aqua; such a projector-friendly color-to-hour matrix is presented in FIG. 30.

Figure 25:
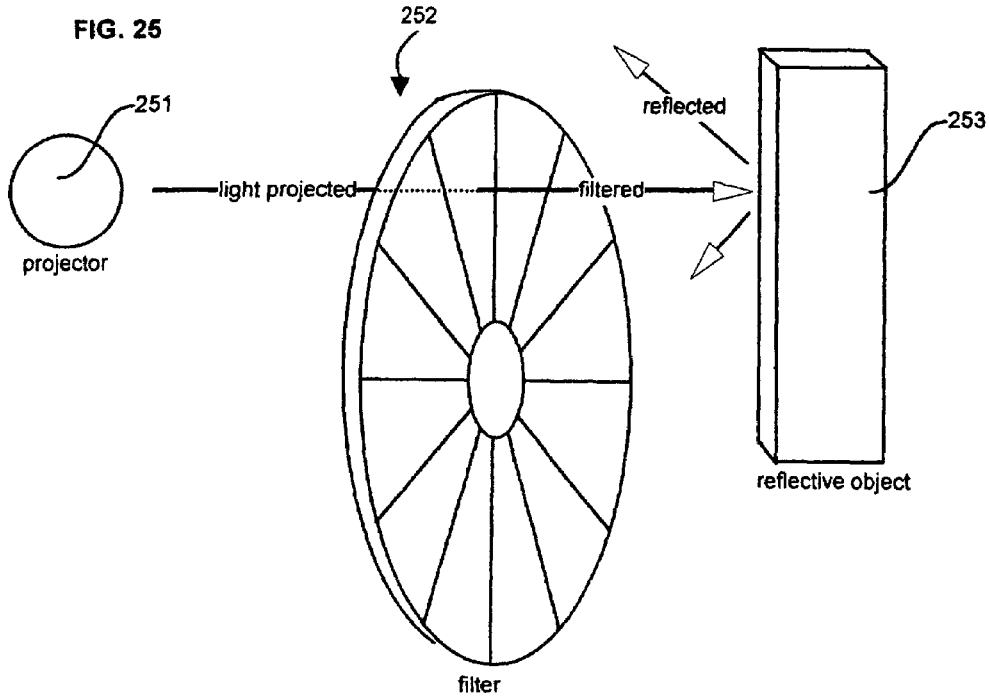
FIG. 25 depicts a schematic diagram of the essential features of a colored light projector system, one in which a spotlight and colored gel light filters are used.

For use in the projector-based approach, a projector system, depicted schematically in FIG. 25, includes a translucent color dial 252, which provides twelve different colored translucent gels or segments of colored glass, each of which only allows certain frequencies of light to pass through, thereby changing the color of the light being emitted by the light source 251 from white to another color. These segments are arranged according to the sequence of colors in the color-to-hour matrix. A light source 251 projects white light through one segment of the translucent color dial 252. Once the color of the light has been changed by being filtered through the translucent color dial 252, it encounters a reflective object 253 and reflects. If the reflective object 253 is white when exposed to white light, and no other significant light source is present, then the color of the reflective object 253 will appear to be whatever color the light is that has just come through the translucent color dial 252.

As in previous embodiments, the translucent color dial 252 turns intermittently, turning exactly one 12th of a complete revolution at the top of every hour such that the gel of the color that corresponds to the current hour of the day is inserted into the path of light.

Figure 26:
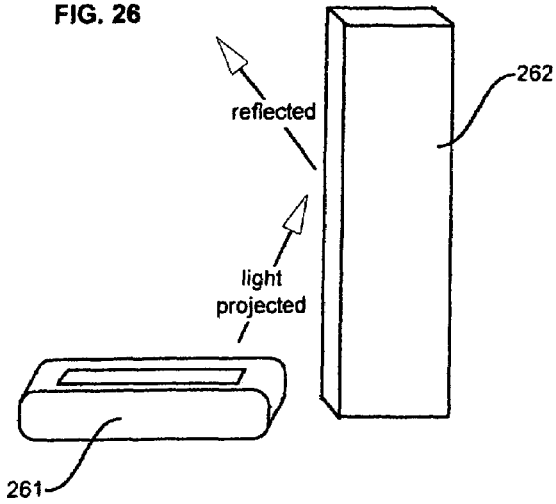
FIG. 26 depicts a schematic diagram of a different colored light projector system, one in which a light-emitting flat-panel display is used.

Alternately, rather than using a mechanical spotlight approach, a light-emitting, color flat-panel video display can be used to project light on a light-reflecting object. In FIG. 26, a flat-panel display 261 is placed in front of a reflective object 262 so that some of the light that the display 261 emits reflects off the object 262. If the object 262 is white when illuminated with white light, then the object will reflect whatever color is the color of the light projected upon it. The display 261 displays a single color which is the color corresponding to the active hour according to the color-to-hour matrix.

Figure 27:
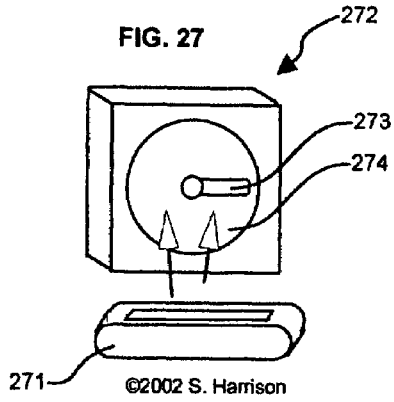
FIG. 27 depicts a perspective view of a time display device for use in a time display system in which a light projector projects light upon a light-reflecting minute hand that is set against a nonreflective clock face.

FIG. 27 depicts such a light-emitting display 271 oriented such that it casts light onto a clock 272 that features a minute hand 273. When exposed to white light, the minute hand 273 is white. The remainder of the clock face 274 is black. Thus, when no other significant light source is present, the minute hand 273 reflects the color of the light being emitted by the light-emitting display 271 while the clock face 274 reflects no light, i.e., remains black. In this way, the minute hand conveys both minute information through position and hour information through color.

In the device depicted in FIG. 28, suitable for desktop use or installation into walls, a display 281 shines light into an aquarium-like container 282 of clear liquid 283. The color of the light being projected changes with each hour as described above. A white (i.e., when exposed to white light) ball 284 floats in the liquid 283, reflecting the color of light projected upon it. The floor of the container includes a valve 285 which covers an air duct 286 through which air can flow into the container. The air duct 286 is configured to conduct air that is pumped by an air pump 287 into the container 282.

The variable speed air pump 287 is synchronized with the timekeeping mechanism included in the display 271 so that the speed of the pump 287 increases as an hour progresses, thereby pumping an increasing number of air bubbles 288 into the liquid 283. Thus, at the top of the hour only a few bubbles 288 are pumped into the liquid 283; but at fifty-five minutes past the hour, a lot of bubbles are being pumped into the liquid. When the top of the hour is reached again, the air pump 287 resumes its minimum speed, such that only a few bubbles appear. In this way, minute information is conveyed —intentionally imprecisely—by bubbles.

In an alternative embodiment (not pictured), five independent air pumps can be connected to the container through five separate air ducts to lead to five separate valves similar to the air pump configuration depicted in FIG. 28. At the top of the hour, all air pumps are off. Then, at ten minutes past the hour, one pump is turned on so that air is pumped through one of these air ducts; this pump remains on for the remainder of the hour. Ten minutes later, a second air pump begins pumping air into the container, creating a second stream of bubbles. Each stream of air bubbles therefore signifies a 10-minute block of elapsed time, and at the top of the hour, all bubble streams cease, and the process begins again.

To summarize, FIG. 29 depicts the basic steps of the process used in the above projector-based TDD's. A projector capable of projecting different colors of light, such as a spotlight equipped with light filtering gels or a light-emitting display, is constructed 291. A light-reflecting object, preferably one which appears white when illuminated by white light, is positioned relative to the projector so that light projected by the projector falls upon the light-reflecting object 292. Then the color of light that corresponds to the active hour in the color-to-hour matrix is projected upon the reflective object 293. Finally, minute information is conveyed by one of any number of means 294, such as through a minute hand, an hourglass (using white sand and flipping over at the top of each hour), or a stream of bubbles.

FIG. 30 presents an alternative color-to-hour matrix 301, specifically, one which is suitable for use in the above projection/reflection TDD's. Notice that this alternative color-to-hour matrix 301 includes a light phenomenon, specifically, that of a blinking light, in the 12:00 hour time slot instead of a color. Thus between 12:00 and 12:59, a blinking white light indicates the hour, just as a steady white light indicates the 1:00 to 1:59 hour. The use of blinking is not necessary, this feature is included here just to present it as an alternative that still works within the scheme of the color-to-hour matrix.

Section 6: Alternative Embodiment Using Precious Materials

The colors of a given color-to-hour matrix can be embodied in actual precious materials rather than simply in multicolored dials. In creating a color-to-hour matrix for use with precious materials, the same basic process as that depicted in FIG. 1A is used except that the colors chosen for inclusion in the color pool are limited to the colors of precious materials. Such an alternative color pool 311 appears in FIG. 31A. A subset of these colors is selected from this pool 311, and each color in the subset is assigned to a particular hour of the day as per the example of a color-to-hour matrix 312 depicted in FIG. 31B. The depicted color-to-hour matrix 312 uses only the colors of precious materials, such as onyx, pearl, ruby, amber, emerald, sapphire, amethyst, silver, and gold.

An alternative color dial 320 appears in FIG. 32. This dial is similar to that depicted in FIG. 4, except that, in this dial 320, each color segment 322, rather than simply being a colored piece of plastic or other material, is inlaid or encrusted with precious metals or stones or other precious materials 321. This color dial 320 therefore operates just as the rotating color dials depicted above: one precious material 321 shows through an aperture in the clock face of the TDD per hour for essentially the entire hour; the surface of this precious material reflects the color that represents the active hour as per the special color-to-hour matrix 312.

FIG. 33 depicts the time display portion of a watch 330 wherein the watch face 331 includes an aperture 332 through which the encrusted color dial 320 can be partially seen. At the moment in time depicted in FIG. 33, a sapphire stone 333 can be seen through the aperture 332, indicating that the active hour is 7:00 as per the color-to-hour matrix 312. Given the position of the minute hand 334, the time depicted by the TDD 330 is approximately 7:15. At the top of the next hour, the color dial 320 will turn one-twelfth of a complete revolution so as to reveal an amethyst stone, which represents the 8:00 hour in the color-to-hour matrix 312 depicted in FIG. 31B. This particular embodiment, using precious materials as hour indicators, is noteworthy in that it represents one of the few instances in modern culture where gemstones serve a functional role —that of indicating time of day —rather than an ornamental one.

Section 7: Alternative Embodiments Applying the Color-to-Hour System, Method and Device for Use with Months The disclosed system can be applied to months instead of hours with equal success: the processes used to create a color-to-hour matrix can be used to create a color-to-month matrix; the rotating color dial can be used to indicate months by reference to a color-to-month matrix. In the context of precious material usage, a color-to-month matrix is particularly desirable for use with birthstones as follows.

Popular culture has already assigned particular gemstones to particular months of the year such that the month of an individual's birth corresponds to a particular gemstone which is that individual's "birthstone." This popular birthstone assignment is presented as a color-to-month matrix 340 in FIG. 34.

A color dial 350 with encrusted gemstones arranged according to the color-to-month matrix 340 in FIG. 34 is depicted in FIG. 35. Unlike the color dials described above, however, this color dial 350 is intended to turn intermittently only once per month at the beginning of the month rather than once per hour at the top of the hour; such motion will cause a given birthstone to show through an aperture in the clock or watch face for an entire month.

FIG. 36 depicts the time display portion 360 of a watch equipped with a minute hand 361 and an hour hand 362. The color dial 350 from FIG. 35 can be seen through an aperture 363 in the watch face 364. A ruby 365 can be seen through the aperture 363, indicating that the month is July. At the beginning of the next month, the color dial 350 will turn one-twelfth of a revolution so as to reveal a peridot stone through the aperture 363, thereby indicating August as the active month. Given the depicted position of the minute hand 361 and the hour hand 362 and a ruby 365 visible through the aperture 363 in the clock face 364, the time depicted in FIG. 36 is approximately 12:15 on some day in July. Obviously, the depicted features can be combined with a date indicator (not shown) as well, so that an observer could know which day in July.

Figure 38:
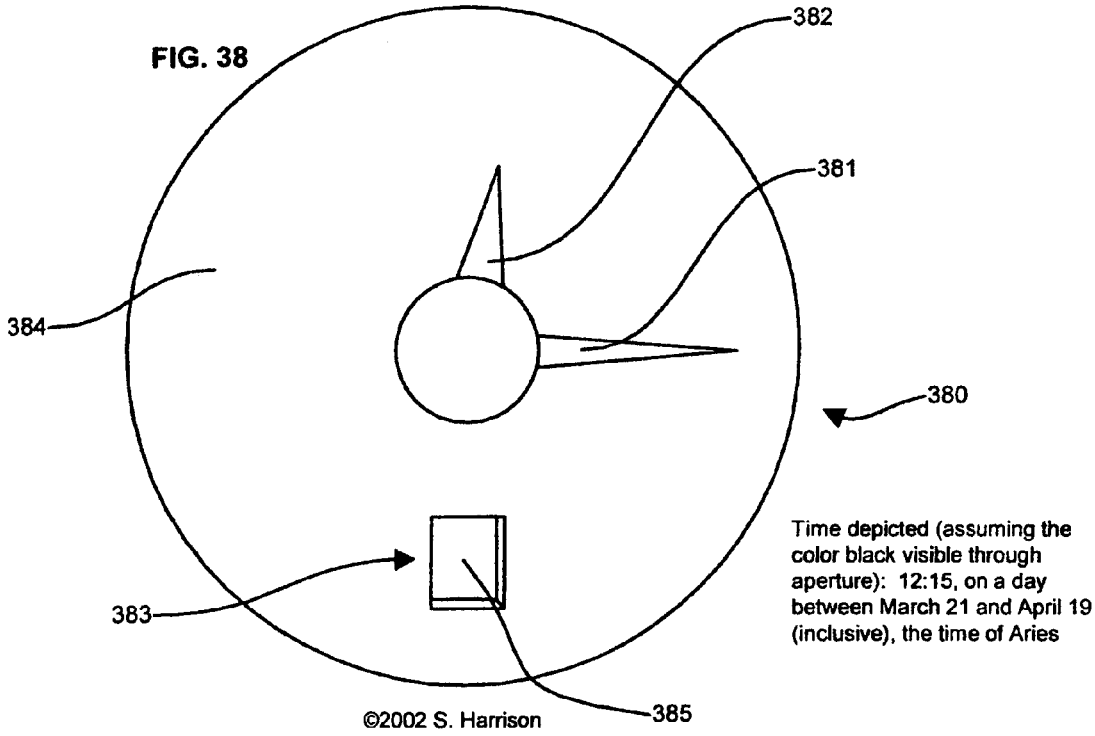
FIG. 38 depicts an anterior view of the essential components of a time display device for use in a system in which zodiac month information is indicated by the display of a color, hour information is indicated by an hour hand, and minute information is indicated by a minute hand.

The same basic mechanisms depicted above can be combined in a TDD that indicates the current zodiac month rather than the current calendar month. A color-to-month matrix 370 in which colors are assigned to zodiac months appears in FIG. 37. A rotating color dial embodying the color sequence of this color-to-month matrix 370 turns intermittently once per month at the top of the month, as in the previous embodiment 360, except that the top of the month is defined by the zodiac calendar, the pertinent dates of which are listed in FIG. 37. Thus, referring to FIG. 38, if the black color segment of a rotating color dial 385 is visible through the aperture 383 in the clock face 384, then the current month, according to the zodiac calendar, is Aries.

Section 8: Using Environmental Sensors to Toggle Between Display Modes

Figure 3D:
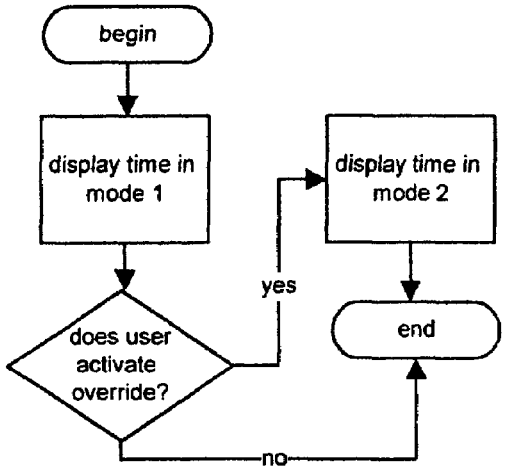
FIG. 3D depicts a flowchart illustrating the process by which the device depicted in FIG. 3A is switched into a different display mode.
Figure 39:
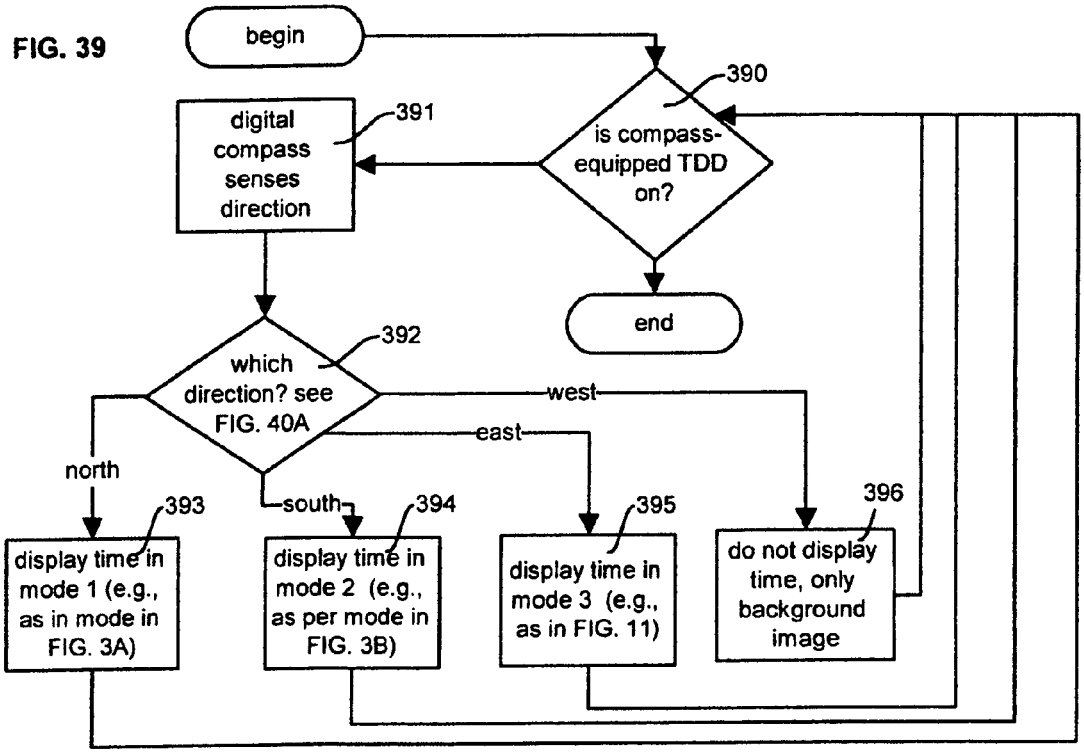
FIG. 39 depicts a flowchart illustrating the process by which an environmental sensor is used to automatically switch a time display device from one display mode to another according to the sensory values sensed by the sensor.

Rather than require the user to manually switch the TDD from one display mode to another as per the process depicted in FIG. 3D, an environmental sensor can be included in the device to automatically switch between display modes. Typically, switching between programs in a Palm PDA or a desktop computer running Microsoft Windows, a user clicks on an icon to display a given program or window. FIG. 39 illustrates how the process of switching between functions can be automated so that sensory values detected by an environmental sensor take the place of manually clicking on an icon.

Assuming that a TDD equipped with a digital compass is on 390, the digital compass senses the directional orientation of the TDD 391. By the process depicted in FIG. 40A, a compass heading of north, south, east, or west is determined 392. If the compass heading is north, time is displayed in a first display mode 393. If the compass heading is south, time is displayed in a second mode 394. If the compass heading is east, time is displayed in a third mode 395. If the compass heading is west, the display displays a fourth mode, in which mode time is not displayed, only the user-selected background image is displayed 396.

FIG. 40A depicts the process by which compass degrees are converted to general compass headings for use in toggling between display modes. A conventional digital compass senses directional orientation in such a way that there are 360 possible sensory values or compass degrees that the digital compass can output, as though each possible directional orientation were a point on a circle where north is at 0 degrees, east is at 90 degrees, south is at 180 degrees, and west is at 270 degrees. For use with the present system, the first step is to group all possible values or compass degrees together into four sets or groups of possible values 401. Each of these sets is then assigned an outcome 402, namely, a particular display mode.

Then, a digital compass is in installed in a TDD such that sensory values detected by the digital compass are output to the data processor of the TDD 403. Finally, sensory values detected by the digital compass are converted by the processor of the TDD to outcomes 404 per the value conversion map depicted in FIG. 40B.

Any number of environmental sensors can be used instead of a digital compass; some example options are listed in FIG. 40C. Although actual numerical values differ from sensor to sensor, the process used to group the sensory values detected and output by a given environmental sensor and then assign groups to outcomes is essentially the same as that described above. Any number of TDD functions can be associated with outcomes; some example outcome functions are listed in FIG. 40D. Particularly noteworthy is the function of displaying a phone number stored in the memory of the TDD; this feature allows mobile phone users to look through stored phone numbers simply by pointing their phone in different directions.

Figure 41:
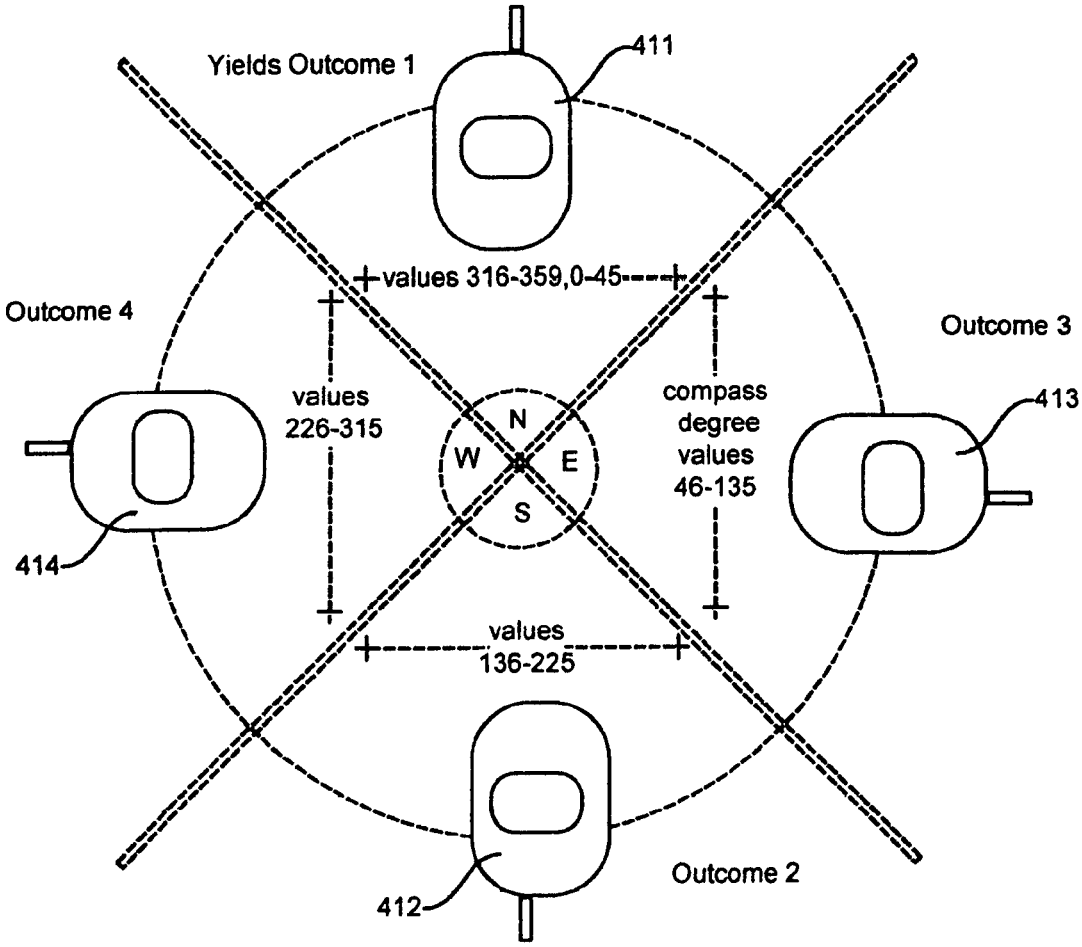
FIG. 41 schematically depicts the outcomes associated with possible compass degree or directional values.

The mapping of values to outcomes depicted in linear form in FIG. 40B is reiterated graphically in FIG. 41. When a TDD 411 is facing north, meaning that the compass has detected a value falling in the depicted range, outcome 1 results. When a TDD is facing east 413, south 412, or west 414, the resulting outcome is outcome #3, outcome #2, or outcome #4, respectively. The display modes associated with each of these outcomes are not depicted in FIG. 41.

Any of the environmental sensors that sense motion can also be used to enable an energy-saving "sleep" mode: when the device has been substantially motionless for more than 15 minutes, i.e., no changes in sensed values have occurred, the electronic display turns off. It then reactivates when motion is detected.

Figure 42:
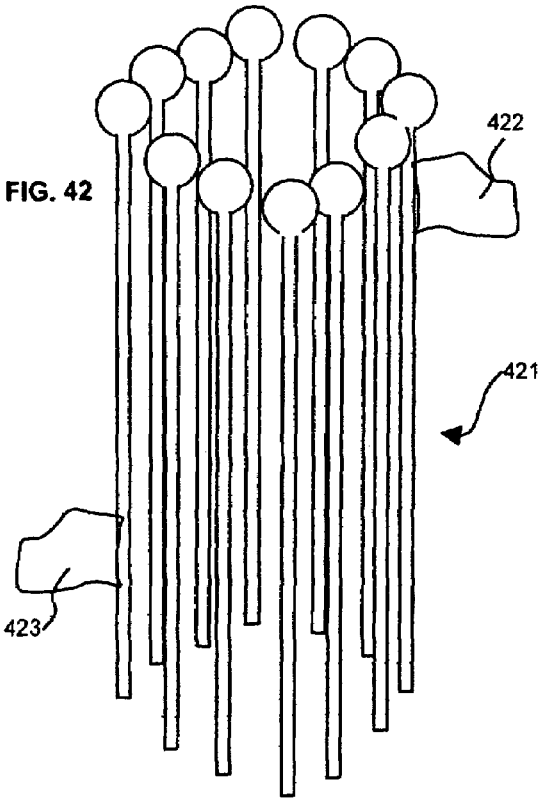
FIG. 42 depicts an anterior view of certain components of a device for use in a system in which hour information is indicated by a flag by way of reference to a color-to-hour matrix.

Section 9: Alternative Embodiments Exemplifying Adaptability of the Present Invention FIG. 42 depicts a group of twelve flagpoles 421 for displaying twelve flags. One flag 422 is in a fully raised position. One flag 423 is in a fully lowered position. The other ten flags are not depicted in the Figure for the sake of simplicity. Each flag is a different color, one of the colors in the color-to-hour matrix. In the depicted arrangement, the flag that is the color of the active hour is raised to the fully raised position. The other eleven flags are kept at a fully lowered position until the given hour associated with each flag becomes the active hour. Raising of the active hour flag can be manually accomplished by a human being, simply going by whatever time is displayed on his own watch, or be by mechanical means electrically coupled to a timekeeping mechanism. Since a flag can be viewed from virtually any direction, such an embodiment would be particularly well-suited for use at a beach or other outdoor setting where people are not likely to wear watches but would appreciate knowing what hour of the day it is.

Figure 43A:
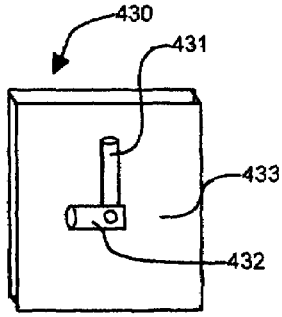
FIGS. 43A, 43B, and 43C depict perspective views of the components of a device for use in a system in which time of day information is indicated by an analog clock of which the clock face is clear such that a flat-panel display positioned behind the clock face can be seen by an observer.
Figure 43B:
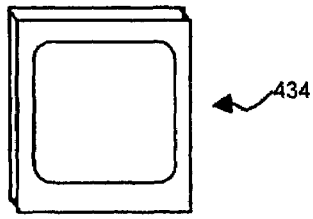
Figure 43C:
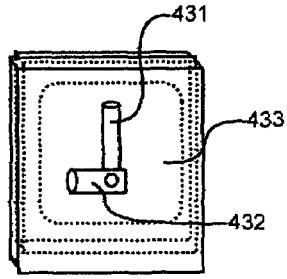

FIG. 43A depicts a physical, analog clock 430 that includes a minute hand 431 and an hour hand 432 which are mounted upon a clear piece of glass or plastic 433 that serves as the clock face. FIG. 43B depicts a flat-panel display 434 equipped with data exchange mechanisms as per previous embodiments. FIG. 43C depicts the clock 430 from FIG. 43A placed in front of the flat-panel display 434 from FIG. 43B. In this configuration, the flat-panel display 434 can be seen through the clear glass 433 of the clock 430 so that the background of the physical, analog clock can be infinitely manipulated just as the background images in other embodiments using a flat-panel display. Thus, the physical sensibility of a set of physical clock hands is combined with the infinite configurability of a computer display, and when the display 434 displays the color of the hour behind the minute hand 431 and the hour hand 432 in the depicted embodiment, the combined device pictured in FIG. 43C serves as an excellent training tool by which users can learn the color-to-hour matrix.

Figure 44:
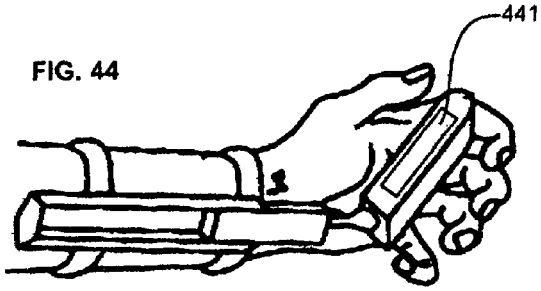
FIG. 44 depicts a perspective view of a time display device according to the present invention mounted as a key palette so that the time display device can move in and out from under a user's shirt sleeve.

FIG. 44 depicts a TDD mounted as a key palette so that it can move in and out from under a user's shirt sleeve. Other key palette mountings provide mechanisms that allow the TDD to revolve, swivel, or tilt (not pictured).

Since the color-to-hour matrix time display method does not typically include the use of numbers or letters, time displays can be incorporated into household objects or clothing in such a way as to hide the fact that they serve any timekeeping function, or any function at all beyond that of decoration. For instance, a time display display can be incorporated into a picture frame, a belt buckle, a piece of luggage, a candlestick, a bookend, furniture, or another nontypical timekeeping device.

FIG. 45 presents an alternative time display mode that does not capitalize on the color-to-hour matrix system but corrects a defect in the prior art. Specifically, while gradual changes in color along a continuum do not allow enough precision for use as an absolute indicator of both hour and minute information, such continual change can be successfully used as a general indicator of minute information alone as follows.

Figure 45A:
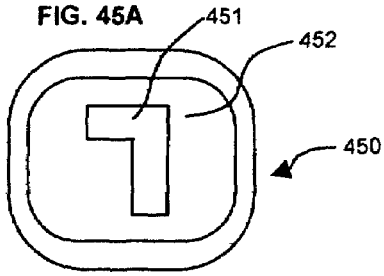
FIGS. 45A and 45B depict anterior views of a time display device for use in a system in which hour information is indicated by alphanumeric character and minute information is indicated by the current color of this character.

In FIG. 45A, a flat-panel display 450 depicts a numerical digit 451 set against a background image 452. This numerical digit 451 conveys hour information digitally, i.e., the alphanumeric character directly states the active hour. Thus, since the digit 451 depicted in FIG. 45A is a "7", the active hour is 7:00.

Minute information in this time display mode is indicated by color, specifically, the color of the digit 451. At the top of the hour, the digit 451 is blue. At twelve minutes past the hour, the digit 451 has gradually changed from blue to green. At 24 minutes past the hour, the digit 451 has changed to yellow. At thirty-six minutes past the hour, the digit 451 has changed to orange. Twelve minutes later, i.e., at forty-eight minutes past the top of the hour, the digit 451 has changed from orange to red. The digit then remains red until the end of the hour. When the top of the next hour is reached, the new active hour is indicated numerically, using a digit or digits that are blue. Then the process of the digit or digits changing from blue to green to yellow to orange to red resumes.

Thus, in FIG. 45A, assuming that the numerical digit image 451 is yellow, then the time depicted in FIG. 45A is approximately 7:24, given that the image 451 is of a numeral "7", indicating the active hour as seven o'clock.

Figure 45B:
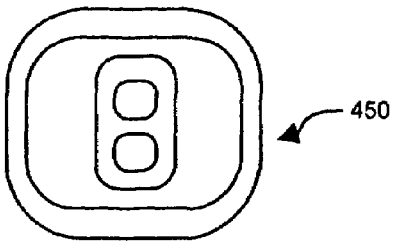

FIG. 45B depicts the same flat-panel display 450 approximately forty minutes after the time depicted in FIG. 45A. The numerical digit is now an "8"; thus, assuming that this digit is blue, then the time is shortly after 8:00.

Figure 46:
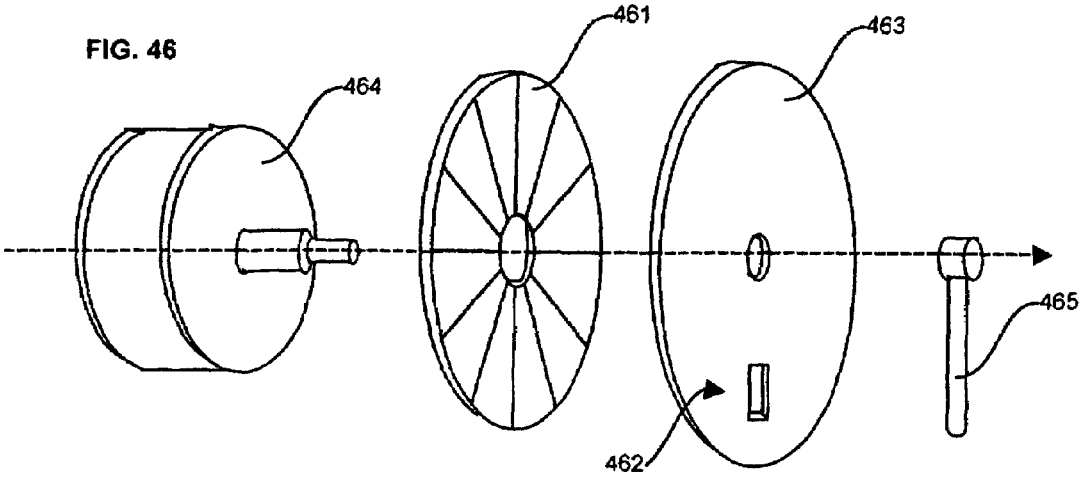
FIG. 46 depicts an exploded view of the primary components of a time display device in which a rotating multicolored dial hour indicator, a clock face with an aperture for viewing the multicolored dial, a conventional gearbox for movement of the minute and hour indicators, and a standard minute hand are used.

FIG. 46 depicts an exploded view of four essential components of a time display device wherein hours are indicated by a rotating multicolored dial 461 that can be partially viewed through an aperture 462 in a clock face 463 that otherwise covers the dial 461. The rotating color dial 461 and the minute hand 465 are mounted on the gearbox 464 so as to turn in their respective ways.

Licensing information may be obtained through www.inventerprise.com.

What is claimed is:

1. A time display method suitable for use in conveying current time of day in minutes and hours to an observer, said time display method comprising the following steps:

providing for keeping time, said step of keeping time being performed through use of a timekeeping mechanism, said timekeeping mechanism being selected from the group consisting of (i) a mechanical movement, (ii) a quartz movement, and (iii) a transmission receiver;

providing for indicating current time of day in minutes and hours such that a first hour is indicated to be the current hour of said day and a first minute is indicated to be the current minute of said first hour, said step of providing for indicating current time further comprising a step of providing for displaying a first symbol against a background, said first symbol comprising at least a first alphanumeric character, said first alphanumeric character comprising at least a first color, said background comprising at least a second color;

providing for sensing at least one sensory value, said at least one sensory value being based at least in part on at least one of a first position of said timekeeping mechanism, a second position of said timekeeping mechanism, or a relationship between said first position and said second position; and selecting a first time display mode according to said at least one sensory value;

wherein:

said step of providing for indicating current time of day is performed through use of an electronic display mechanism, said electronic display mechanism selected from the group consisting of (i) a flat-panel display, (ii) a touch sensitive display, (iii) a projector, (iv) a wearable display, (v) a vehicle, and (vi) a mobile phone;

said first symbol indicates that said first hour is current; and a color indicates that said first minute is current.

* * * * *